US007270493B2

(12) United States Patent
Unotoro

(10) Patent No.: US 7,270,493 B2
(45) Date of Patent: Sep. 18, 2007

(54) PRINTER

(75) Inventor: Hirotsugu Unotoro, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 258 days.

(21) Appl. No.: 11/196,712

(22) Filed: Aug. 4, 2005

(65) Prior Publication Data

US 2006/0067774 A1 Mar. 30, 2006

(30) Foreign Application Priority Data

Sep. 24, 2004 (JP) ..... 2004-278313

(51) Int. Cl.
*B41J 11/00* (2006.01)

(52) U.S. Cl. ..... 400/582; 400/583.1; 400/583.3; 400/583.4; 400/242

(58) Field of Classification Search ..... 400/582, 400/242, 583.1–583.4
See application file for complete search history.

(56) References Cited

U.S. PATENT DOCUMENTS

| | | | | |
|---|---|---|---|---|
| 4,477,758 | A | 10/1984 | De Biasi | |
| 5,492,420 | A | 2/1996 | Nunokawa et al. | |
| 5,947,408 | A * | 9/1999 | Miyake | 242/562 |
| 2003/0077098 | A1 | 4/2003 | Nunokawa et al. | |
| 2004/0151526 | A1 | 8/2004 | Pearl et al. | |
| 2005/0162501 | A1 | 7/2005 | Seo et al. | |

FOREIGN PATENT DOCUMENTS

| | | | |
|---|---|---|---|
| EP | 0 592 198 | A2 | 4/1994 |
| EP | 1 104 701 | A2 | 6/2001 |
| EP | 1 258 366 | A1 | 11/2002 |
| EP | 1 559 566 | A1 | 8/2005 |
| JP | 01209162 | A * | 8/1989 |
| JP | A 11-100017 | | 4/1999 |
| JP | 2000001002 | A * | 1/2000 |

* cited by examiner

*Primary Examiner*—Minh Chau
(74) *Attorney, Agent, or Firm*—Oliff & Berridge, PLC

(57) ABSTRACT

A printer capable of printing with high quality by driving the drive motor according to information about a drive current to be applied to a drive motor of a platen roller to feed the printing medium, each of which has the information. Accordingly, the printer comprises the printing medium discrimination sensors to read information about the drive current from the printing medium and the control circuit to adjust the drive current to be applied to the feeding motor according to the information about the drive current for the printing medium.

16 Claims, 19 Drawing Sheets

FIG.7A

| DISCRIMINATION SENSOR (S1～S5) | WIDTH OF PRINTING MEDIUM | KIND OF PRINTING MEDIUM | REFERENCE VOLTAGE VALUE (Vref) | CURRENT VALUE TO FEEDING MOTOR | AVERAGE CURRENT VALUE TO THERMAL HEAD | TOTAL CURRENT |
|---|---|---|---|---|---|---|
| 00000 | PAPER UNSET | | — | — | — | — |
| 00001 | 18mm | HTERMAL PAPER | 4V | 0.4A | 0.25A | 0.65A |
| 00010 | 36mm | HTERMAL PAPER | 4V | 0.4A | 0.5A | 0.9A |
| 00011 | 54mm | HTERMAL PAPER | 4V | 0.4A | 0.75A | 1.15A |
| 00100 | 72mm | HTERMAL PAPER | 4V | 0.4A | 1A | 1.4A |
| 00101 | 18mm | MKP PAPER | 4V | 0.4A | 0.3A | 0.7A |
| 00110 | 36mm | MKP PAPER | 4V | 0.4A | 0.6A | 1A |
| 00111 | 54mm | MKP PAPER | 4V | 0.4A | 0.9A | 1.3A |
| 01000 | 72mm | MKP PAPER | 4V | 0.4A | 1.2A | 1.6A |

FIG.7B

| DISCRIMINATION SENSOR (S1～S5) | WIDTH OF PRINTING MEDIUM | KIND OF PRINTING MEDIUM | REFERENCE VOLTAGE VALUE (Vref) | CURRENT VALUE TO FEEDING MOTOR | AVERAGE CURRENT VALUE TO THERMAL HEAD | TOTAL CURRENT |
|---|---|---|---|---|---|---|
| 00000 | PAPER UNSET | | — | — | — | — |
| 00001 | 18mm | HTERMAL PAPER | 4V | 0.4A | 0.25A | 0.65A |
| 00010 | 36mm | HTERMAL PAPER | 3V | 0.3A | 0.5A | 0.8A |
| 00011 | 54mm | HTERMAL PAPER | 2V | 0.2A | 0.75A | 0.95A |
| 00100 | 72mm | HTERMAL PAPER | 1V | 0.1A | 1A | 1.1A |
| 00101 | 18mm | MKP PAPER | 4V | 0.4A | 0.3A | 0.7A |
| 00110 | 36mm | MKP PAPER | 3.6V | 0.36A | 0.6A | 0.96A |
| 00111 | 54mm | MKP PAPER | 2.4V | 0.24A | 0.9A | 1.14A |
| 01000 | 72mm | MKP PAPER | 1.2V | 0.12A | 1.2A | 1.32A |

PRINTER

BACKGROUND OF THE INVENTION

1. Field of the Invention

The present invention relates to a printer to print on a printing medium which has been fed, especially relates to controlling a drive current to feed the printing medium.

2. Description of Related Art

Conventionally, there has been widely used a printer which is arranged to operate predetermined printing on a printing medium with a line thermal head, while the printer feeds the printing medium by a printing medium feeding part of a platen. The printing medium may include rolled printing mediums of various widths for thermal printing, each of which is directly mountable in the printer, and a rolled printing medium with a thermal ink ribbon set in a dedicated holder.

A drive current to drive the platen has been generally set high, considering the various widths of the printing mediums to be used. Accordingly, the drive current to drive the platen becomes excessive depending on the widths of the printing mediums. This would cause problems in printing quality and wasteful power consumption.

Japanese unexamined patent publication No. H11(1999)-100017 discloses a label printer having the following structure. This label printer determines the width and a feeding speed of a label sheet based on format data included in print data imported from a personal computer through a communication I/F. In case the label printer determines, e.g., the label sheet is narrow, the printer controls and reduce the amount of electrical power to be supplied to a DC motor, considering that a frictional force of the label sheet between a platen and a line thermal head becomes smaller as the label sheet is narrower and the feeding speed of the label sheet is faster.

However, the label printer in the '017 publication, as above, determines the width and the feeding speed of the printing medium based on the format data included in the print data imported from the personal computer through the communication I/F. The printer does not detect directly the printing medium itself. Therefore, the printer can hardly find that a printing medium of wrong width is being set. Further, even when the width is correct, the printer cannot distinguish materials of the printing mediums.

Furthermore, following points can be pointed out, considering that the frictional force of the label sheet between the platen and the line thermal head becomes smaller as the label sheet is narrower and the feeding speed of the label sheet is faster. Both widths of the thermal ink ribbon and the thermal head are equal in order not to contact the platen with the line thermal head directly. That is, the width of the thermal ink ribbon does not vary with the width of the printing medium. This results in that a frictional resistance increases because the contacting area of the platen and the line thermal head becomes larger as the width of the printing medium is narrower, when thermal paper of different width or a pair of the printing medium and the thermal ink ribbon having the same width as the printing medium to reduce costs is used. This provides an inverse result in the above '017 publication in view of the width of the thermal ink ribbon.

SUMMARY

The disclosure has been made in view of the above circumstances and has an object to overcome the above problem and to provide a printer being capable of printing with high quality by driving a drive motor according to information in each printing medium unit about a drive current to be applied to the drive motor of a platen roller feeding the printing medium.

To achieve the purpose of the disclosure, there is provided a printer comprising a printing medium unit including information about a drive current, a line thermal head for printing on the printing medium, a platen roller for feeding the printing medium, a drive motor for driving the platen roller, a reading device for reading the information about the drive current from the printing medium, and a controller for adjusting the drive current to be applied to the drive motor according to the information of the drive current which the reading device reads from the printing medium.

The printer described above comprises the reading device to read the information about the drive current from the printing medium, and the controller to adjust the drive current to be applied to the drive motor according to the information about the drive current for the printing medium detected by the reading device. Accordingly, the printer drives the drive motor with the drive current appropriate to the width of each printing medium so that the printer can avoid a waste of the power consumption caused due to driving the drive motor by the maximum drive current regardless of the width of the printing medium. Further, the printer can provide uniform printing quality of the printing mediums of any width. Furthermore, the information of the drive current is directly read from the printing medium, so that the mismatch between the widths of the printing mediums and the drive current can be surely avoided. The printer drives the drive motor at the drive current appropriate to each printing medium, which makes it possible to lower the power peak. The reduction in power peak of the printer can lower the generation of heat. Further, acoustic noise caused by an excessive drive current can be reduced.

According to another aspect of the disclosure, there is provided a printer comprising a printing medium unit including information about a drive current, a thermal ink ribbon having substantially the same width as the printing medium, a line thermal head for printing on the printing medium through the thermal ink ribbon, a platen roller for feeding the printing medium, a drive motor for driving the platen roller, a reading device for reading the information about the drive current from the printing medium, and a controller, for adjusting the drive current to be applied to the drive motor according to the information of the drive current which the reading device reads from the printing medium.

In the above printer, the thermal ink ribbon having substantially the same width as the printing medium is used to print on the printing medium. The thermal ink ribbon of the maximum width can be used for the printing medium of any width, so that the cost can be reduced.

BRIEF DESCRIPTION OF THE DRAWINGS

FIG. 7A is a table to explain sums of current values to a printing medium feeding motor and average current values to a thermal head according to various widths of rolled printing mediums in a conventional printer;

FIG. 7B is a table to explain sums of current values to the printing medium feeding motor and average current values to the thermal head according to various widths of rolled printing mediums in the printer of the first embodiment;

DETAILED DESCRIPTION OF THE PREFERRED EMBODIMENTS

Figure 1:
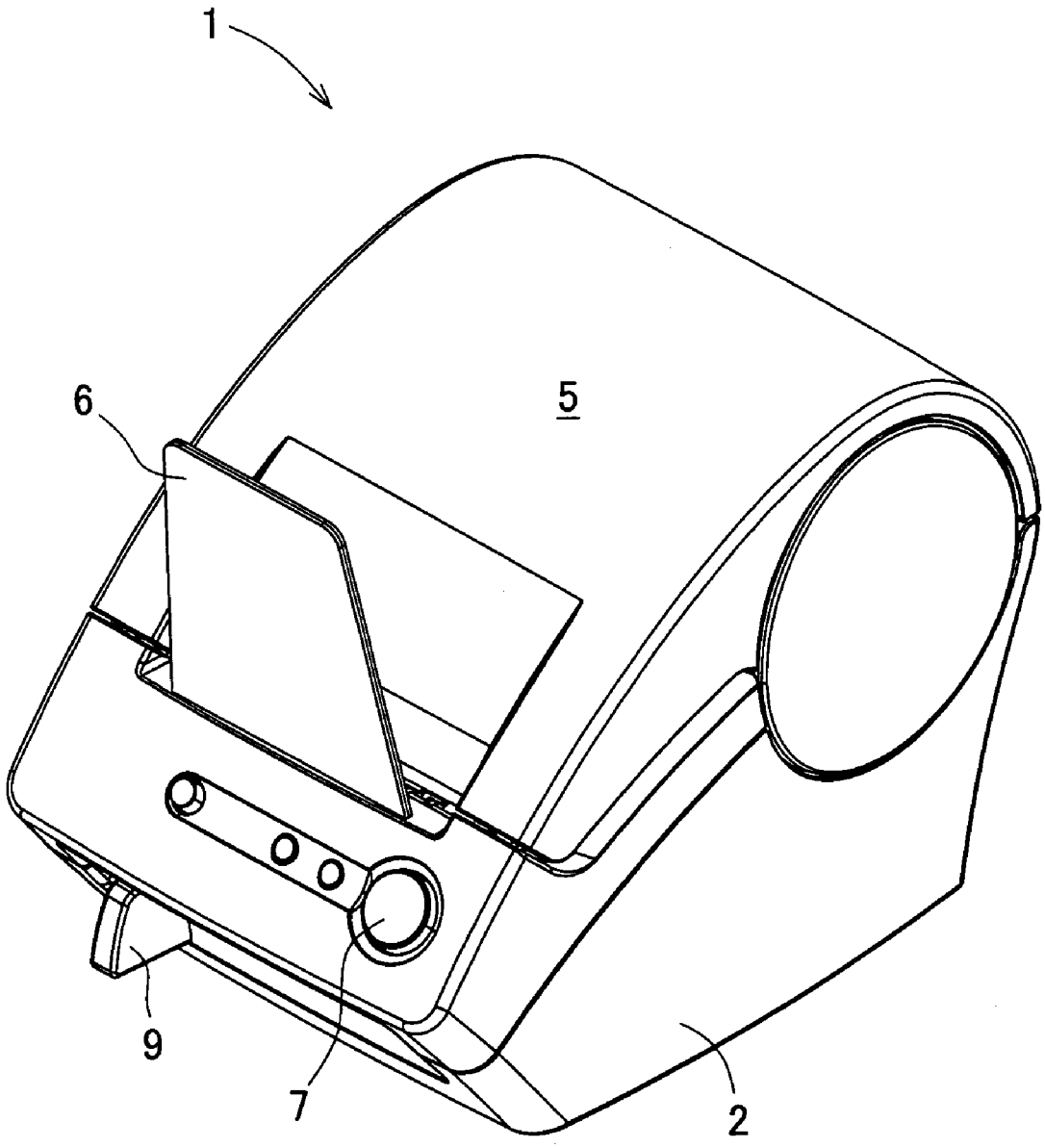
FIG. 1 is a schematic perspective view of a printer in a first embodiment of the present invention.
Figure 2B:
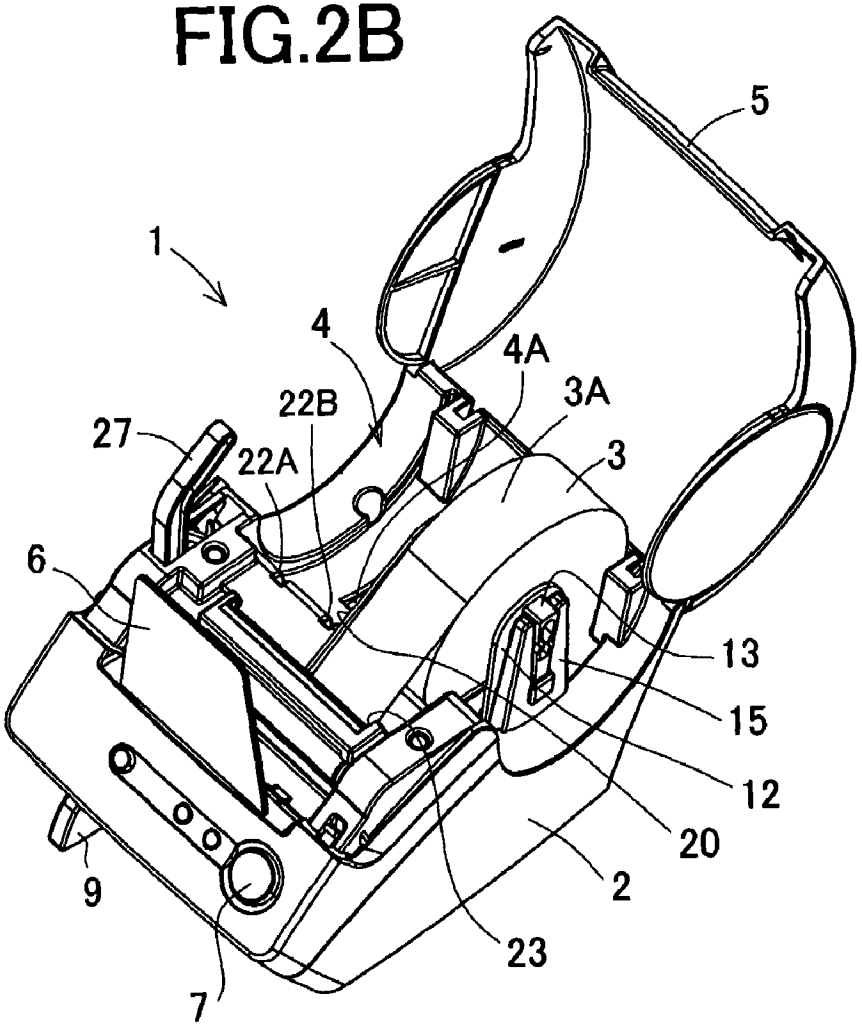
FIG. 2B is a perspective view of the printer in which the printing medium holder holding the rolled printing medium of a width about half the maximum width is mounted.
Figure 2A:
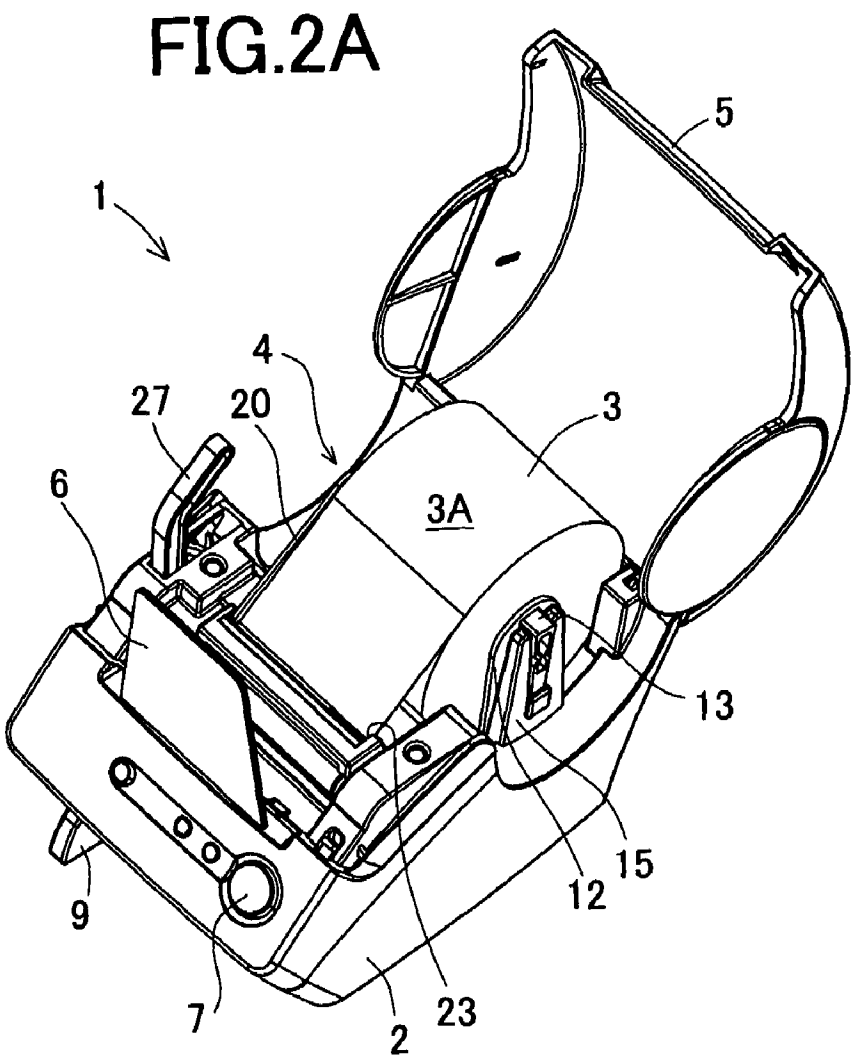
FIG. 2A is a perspective view of the printer in which a printing medium holder holding a rolled printing medium of a maximum width is mounted.
Figure 3:
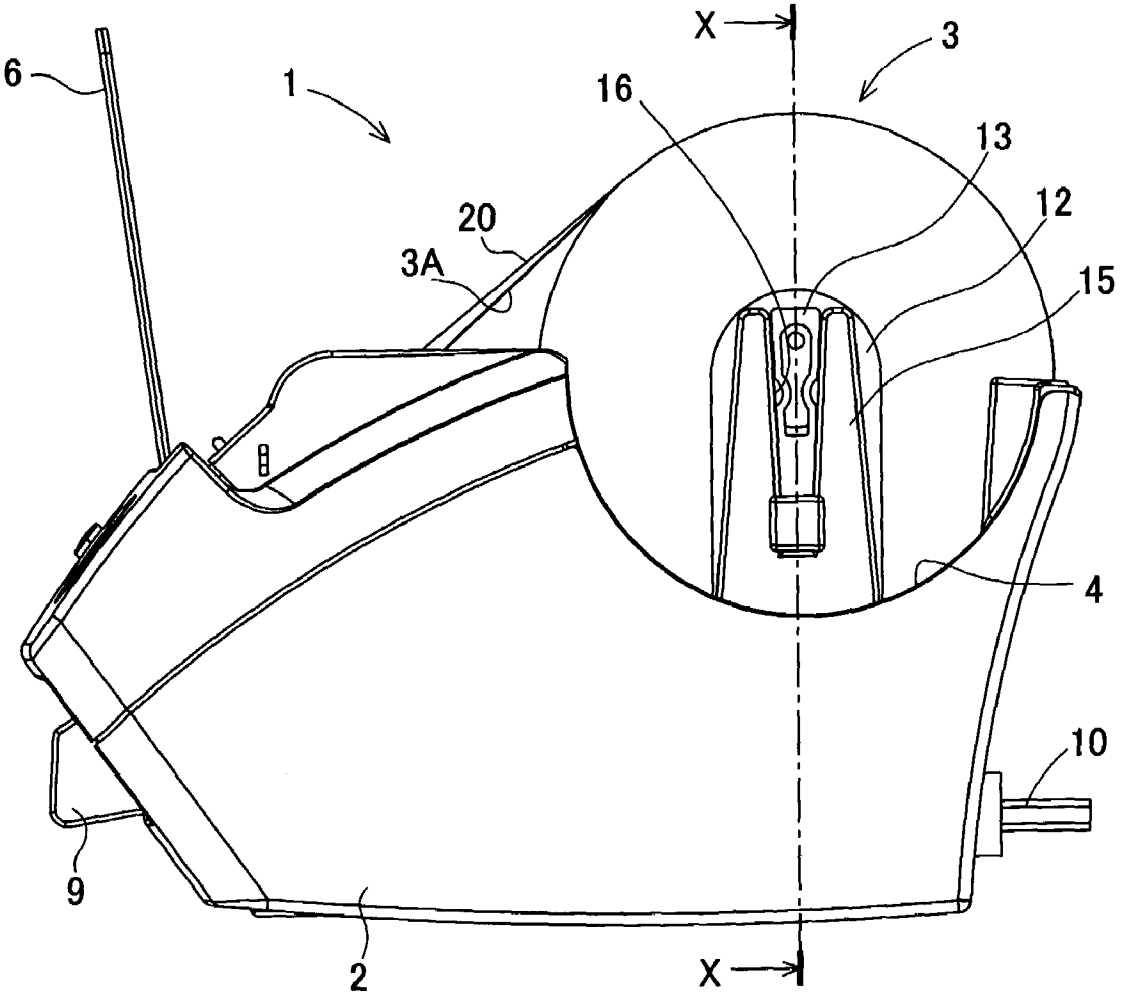
FIG. 3 is a side view of the printer from which a top cover is removed and in which the printing medium holder holding the rolled printing medium of the maximum width is mounted.
Figure 4:
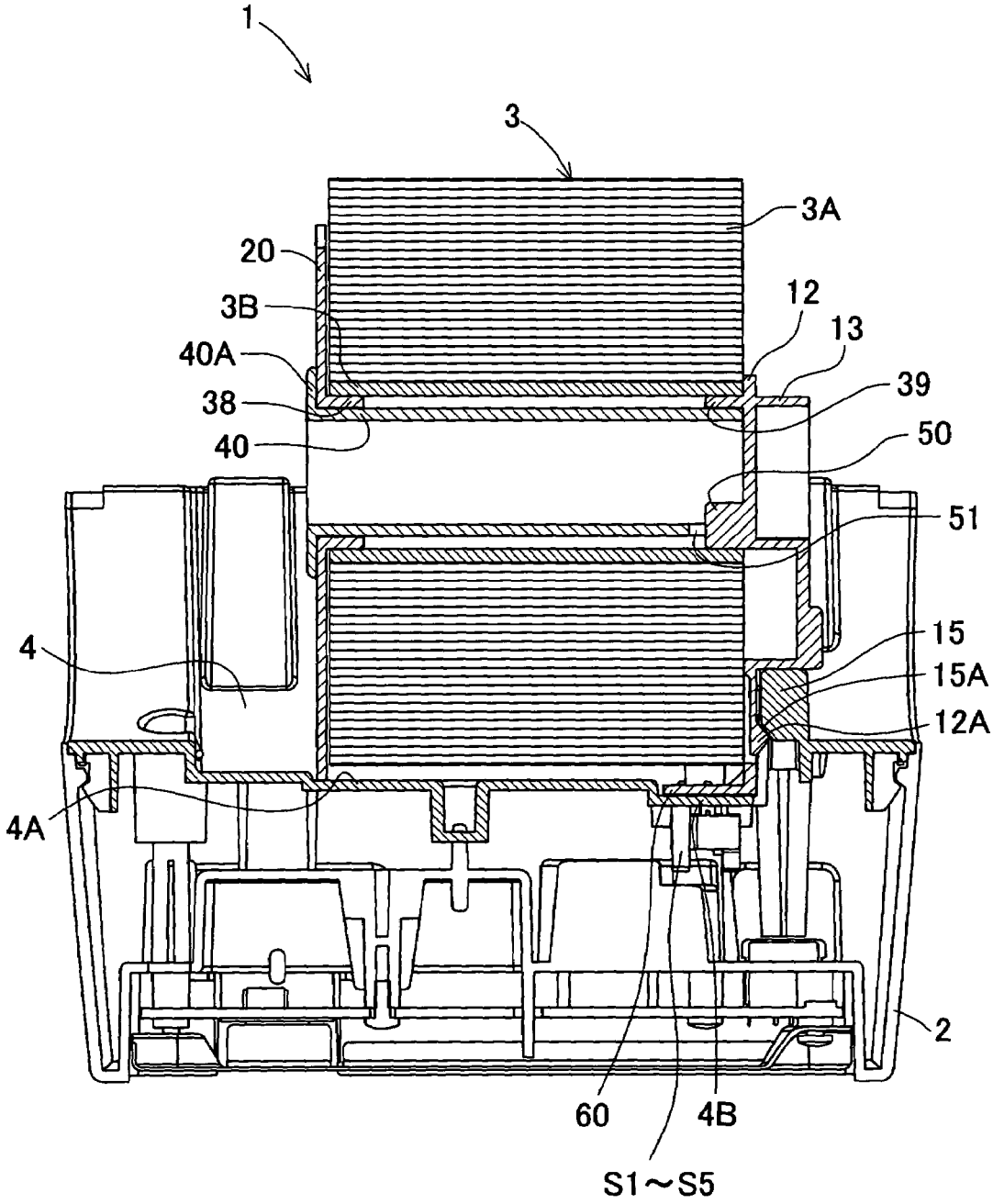
FIG. 4 is a sectional view of the printer taken along a line X-X in FIG. 3.
Figure 5:
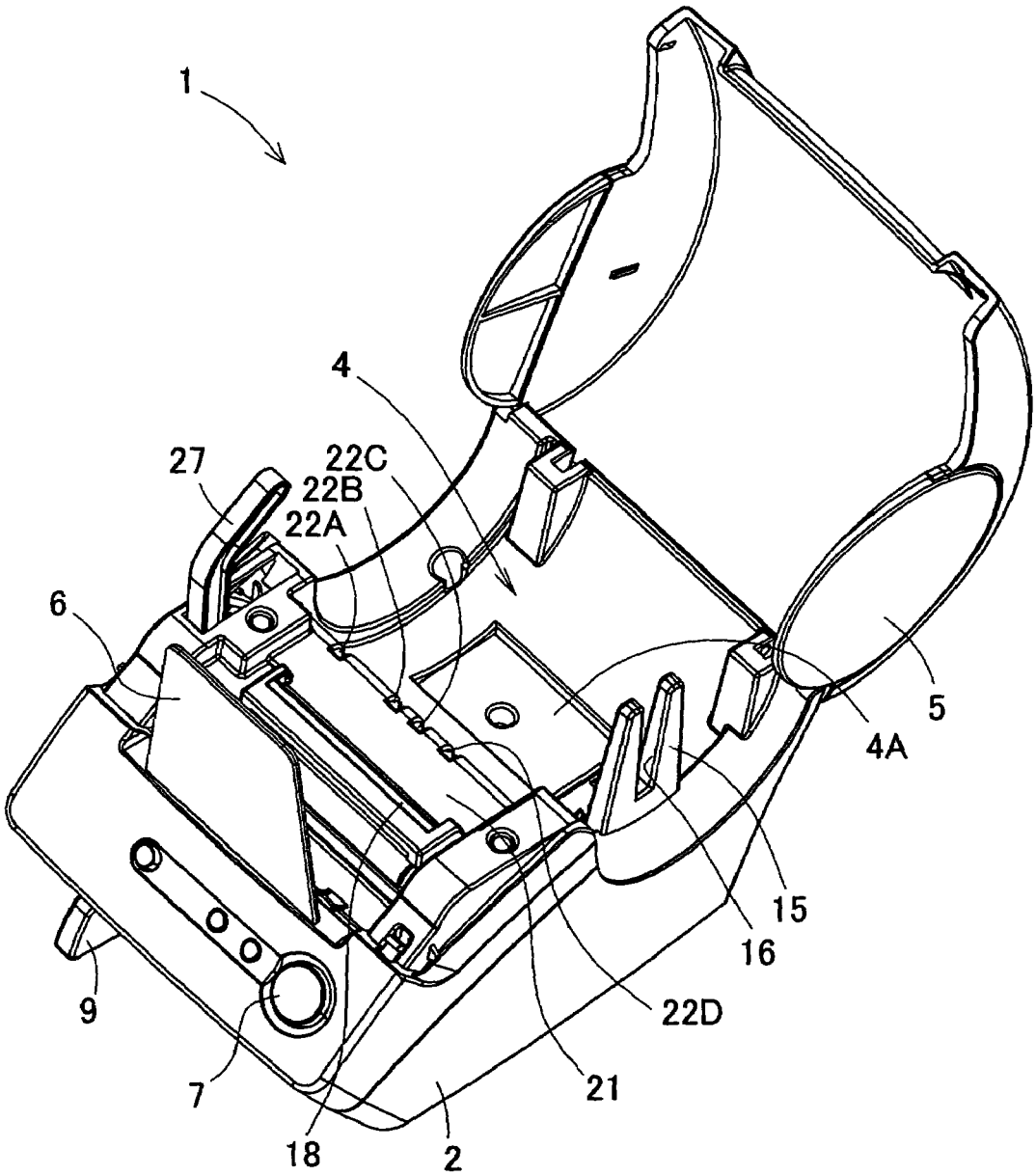
FIG. 5 is a schematic perspective view of the printer with the top cover being opened.
Figure 6:
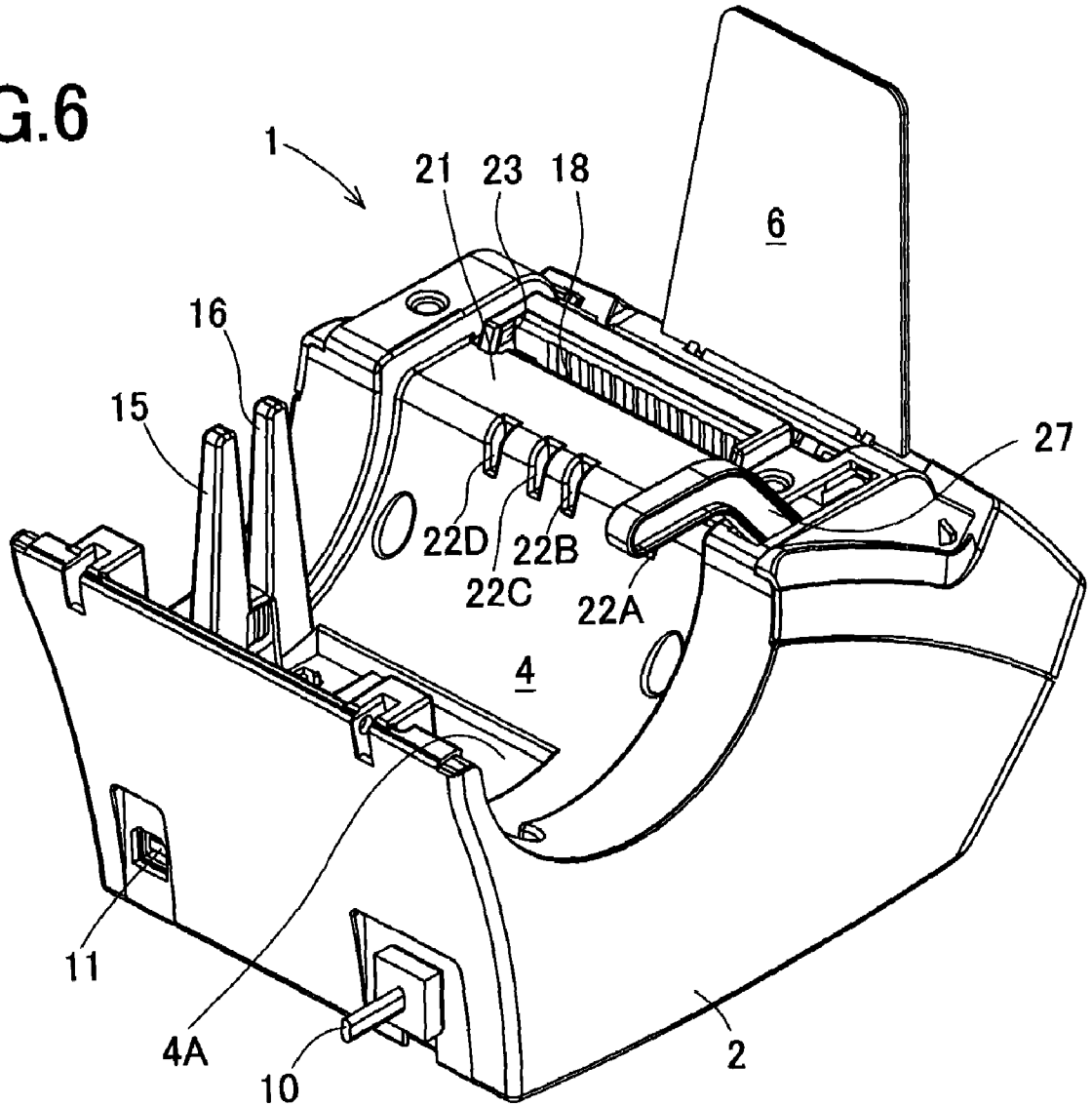
FIG. 6 is a schematic perspective back view of the printer from which the top cover is removed.
Figure 7C:
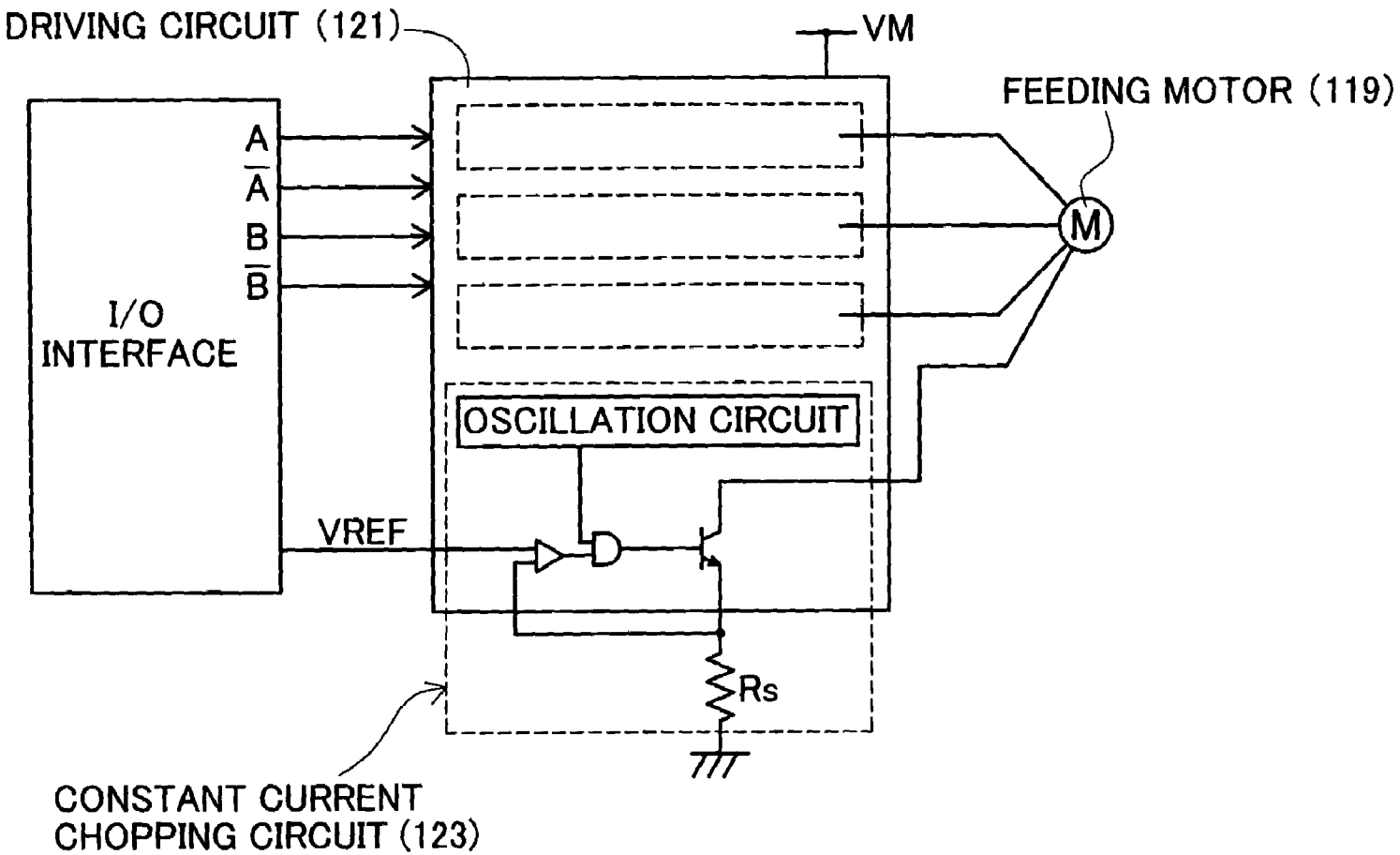
FIG. 7C is an explanatory diagram to show a drive circuit of the printing medium feeding motor.
Figure 8:
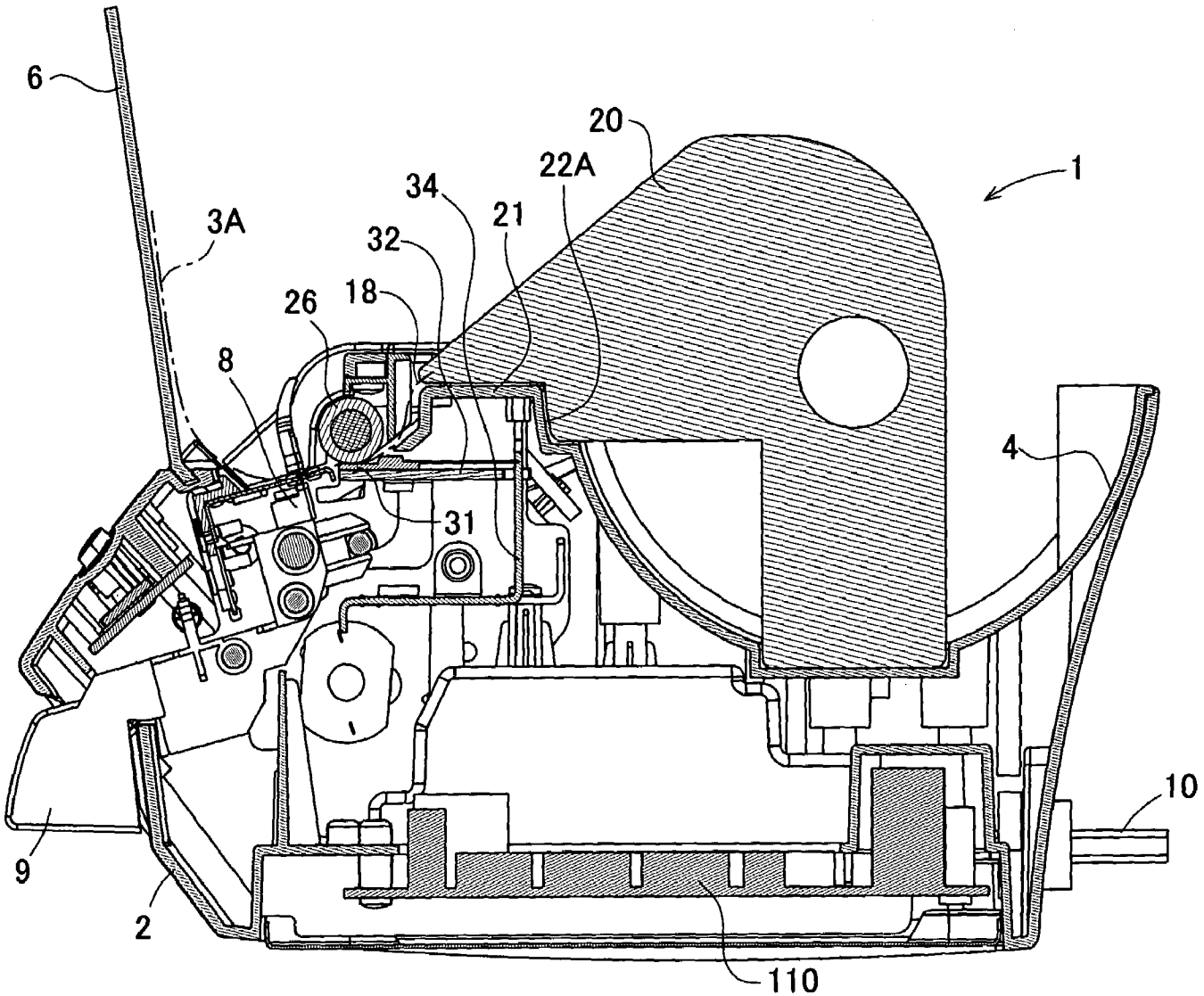
FIG. 8 is a side sectional view of the printer from which the top cover is removed and in which the rolled printing medium holder is mounted.
Figure 9:
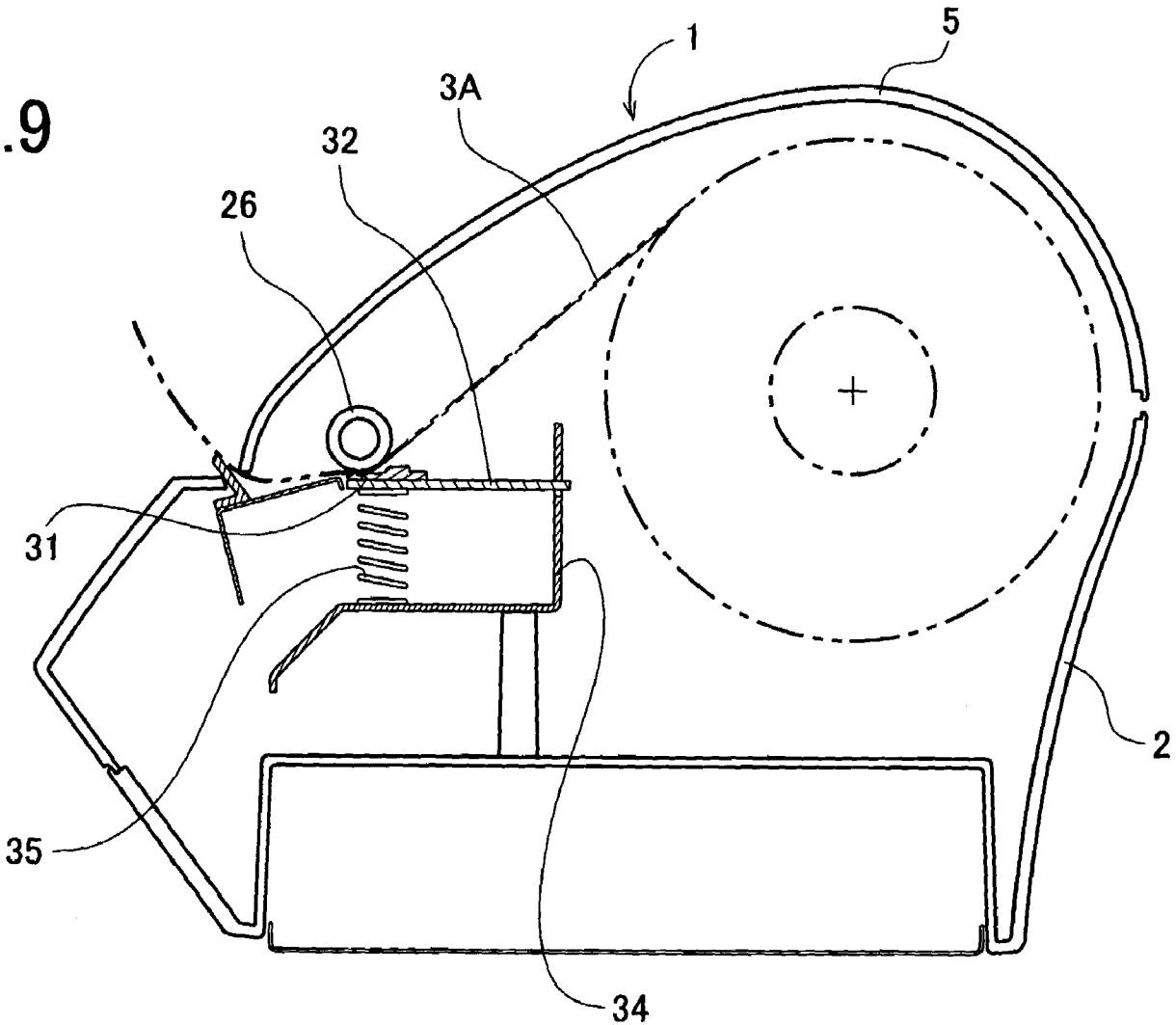
FIG. 9 is a schematic side sectional view of the printer during a printing operation.
Figure 10:
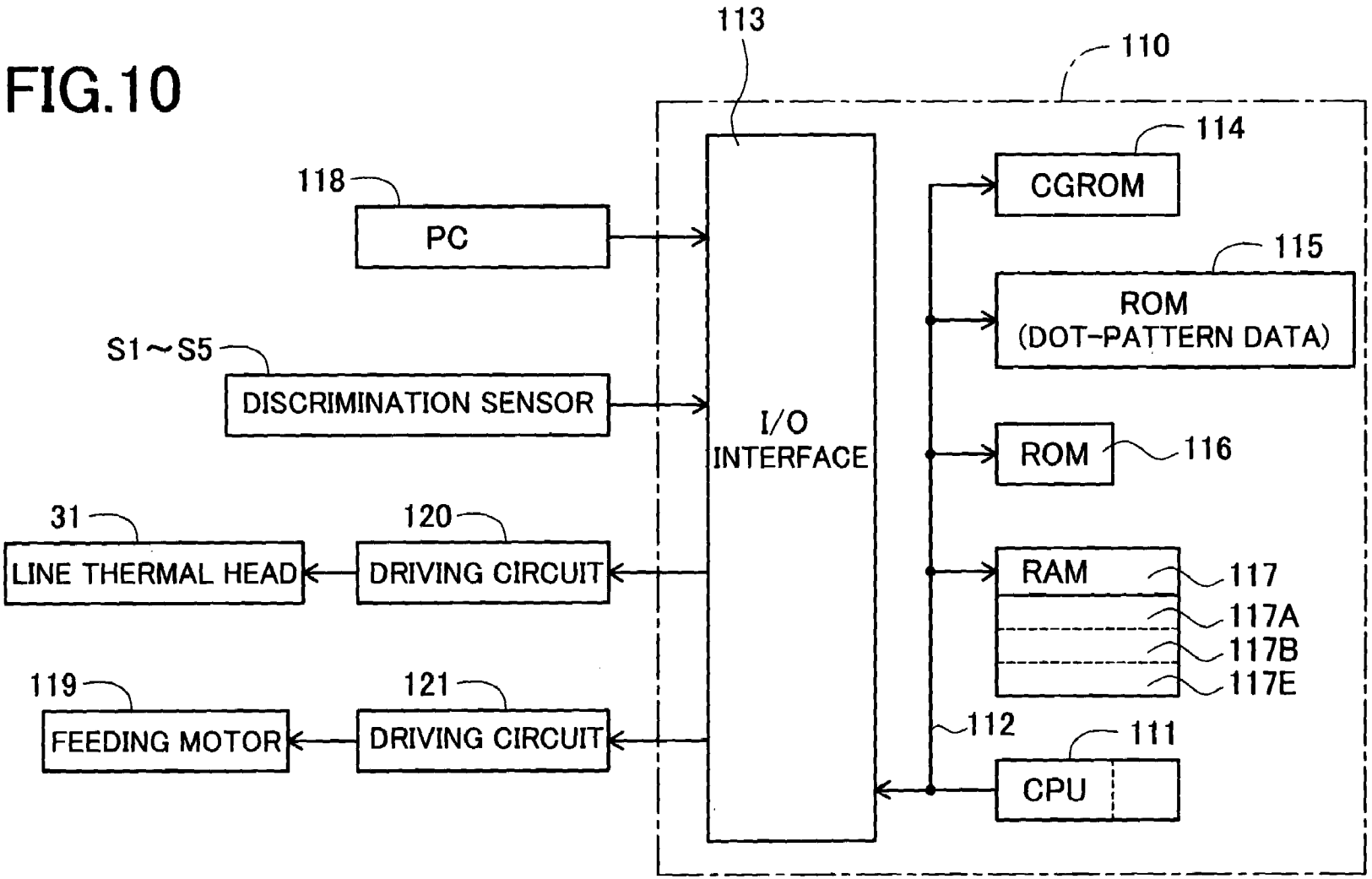
FIG. 10 is a control block diagram of the printer.

A detailed description of a first preferred embodiment of a printer embodying the present invention will now be given referring to the accompanying drawings. Firstly, a schematic structure of the printer in the first embodiment will be explained with reference to FIGS. 1 to 10. FIG. 1 is a schematic perspective view of the printer. FIG. 2A is a perspective view of the printer in which a printing medium holder holding a rolled printing medium of a maximum width is mounted, and FIG. 2B is a perspective view of the printer in which the printing medium holder holding the rolled printing medium of a width about half the maximum width is mounted. FIG. 3 is a side view of the printer from which a top cover is removed and in which the printing medium holder holding the rolled printing medium of the maximum width is mounted. FIG. 4 is a sectional view of the printer taken along a line X-X in FIG. 3. FIG. 5 is a schematic perspective view of the printer with the top cover being opened. FIG. 6 is a schematic perspective back view of the printer from which the top cover is removed. FIG. 7A is a table to explain sums of current values to a printing medium feeding motor and average current values to a thermal head according to various widths of rolled printing mediums in a conventional printer. FIG. 7B is a table to explain sums of current values to the printing medium feeding motor and average current values to the thermal head according to various widths of rolled printing mediums in the printer in the first embodiment. FIG. 7C is an explanatory diagram to show a drive circuit of the printing medium feeding motor. FIG. 8 is a side sectional view of the printer from which the top cover is removed and in which the rolled printing medium holder is mounted. FIG. 9 is a schematic side sectional view of the printer during a printing operation. FIG. 10 is a control block diagram of the printer.

As shown in FIGS. 1 to 3, a printer 1 includes a housing (main body) 2, a top cover 5 made of transparent resin attached to the housing 2 at a rear upper edge, a tray 6 made of transparent resin disposed in a standing position to face to a substantially front center of the top cover 5, a power button 7 placed in front of the tray 6, a cutter lever 9 movable side to side to horizontally move a cutter unit 8 (see FIG. 8), and others. The top cover 5 is freely opened and closed, thereby covering an upper part of a printing medium holder storage part (hereinafter, a "holder storage part") 4 which is a space for receiving a printing medium unit including a printing medium holder 3 and a rolled printing medium 3A of a predetermined width held in the printing medium holder 3. A power cord 10 is connected to the housing 2 on a back face near a corner. The housing 2 is provided on the back face near the other corner with a connector part 11 (see FIG. 6) such as a USB (Universal Serial Bus) which is connected to for example a personal computer not shown. The rolled printing medium 3A is formed of long thermal paper having a self color development property or MKP paper. The rolled printing medium 3A is in a wound state around a hollow cylindrical sheet core 3B (see FIG. 4).

As shown in FIGS. 2A, 2B through 6, the printer 1 is provided with a holder support member 15 in the holder storage part 4 at a side end (a left side end in FIG. 6) in a substantially perpendicular direction to a printing medium feeding direction. The holder support member 15 receives a mounting piece 13 of a positioning holding member (hereinafter, a "holding member") 12 constructing the printing medium holder 3 mentioned later. The mounting piece 13 is provided protruding in a substantially rectangular shape in section on an outer surface of the holding member 12. Specifically, the holder support member 15 is shaped like an angled U-shape as seen in side view (FIG. 3) of the printer 1, providing a first positioning groove 16 which opens upward. The holder support member 15 is also formed with a recess 15A which engages an elastic locking piece 12A formed projecting at a lower end of the holding member 12.

The housing 2 is formed with an insertion port 18 into which a leading end of an unwound part of the rolled printing medium 3A is inserted. A flat portion 21 is formed to be substantially horizontal between a rear end (in the feeding direction) of the port 18 and a front upper edge portion of the holder storage part 4. On this flat portion 21, a front end of a guide member 20 of the printing medium holder 3 is placed. The flat portion 21 is provided at a rear corner in the feeding direction with second positioning grooves (four grooves in the present embodiment) 22A to 22D each formed by a substantially L-shaped wall in section and positioned corresponding to each of a plurality of rolled printing medium 3A of different widths. Each of the second positioning grooves 22A to 22D is configured to fittingly receive a front part of the guide member 20 inserted from above, as shown in FIG. 8. Further, the front end of the guide member 20 of the rolled printing medium holder 3 extends to the insertion port 18.

A positioning recess 4A is formed in the bottom of the holder storage part 4. The positioning recess 4A is rectangular in plan view and long sideways in a direction substantially perpendicular to the feeding direction, extending from an inner base end of the holder support member 15 to a position corresponding to the second positioning groove 22A. This positioning recess 4A has a predetermined depth (about 1.5 mm to 3.0 mm in the first embodiment). The width of the positioning recess 4A in the feeding direction is determined to be almost equal to the width of each lower end portion of the holding member 12 and the guide member 20. A discrimination recess 4B is provided between the positioning recess 4A and the inner base end of the holder support member 15. This discrimination recess 4B is rectangular in plan view, which is long in the feeding direction, and has a depth larger by a predetermined amount (about 1.5 mm to 3.0 mm in the first embodiment) than the positioning recess 4A. The discrimination recess 4B will receive a printing medium discrimination part 60 (see FIGS. 4, 11A, and 11B) mentioned later which extends inward from the lower end of the holding member 12 at a right angle therewith. In the discrimination recess 4B, there are provided five printing medium discrimination sensors S1, S2, S3, S4, and S5 arranged in an L-shaped pattern for distinguishing the kind (e.g., width) of the rolled printing medium 3A. These sensors S1 to S5 are each constructed of a well known mechanical switch including a plunger and a push-type microswitch. It is detected whether the printing medium discrimination part 60 has sensor holes (through holes) 60A (see FIGS. 4, 11A, and 11B), mentioned later, at the positions corresponding to the printing medium discrimination sensors S1 to S5 respectively. Based on an ON/OFF signal of each sensor S1 to S5, the kind of the rolled printing medium 3A set in the printing medium holder 3 is detected. Depending on the kind of the rolled printing medium 3A, a control circuit 110 controls a drive circuit 121 to adjust a drive current 122 to be applied to a printing medium feeding motor (hereinafter, referred to as a feeding motor) 119. In the first embodiment, the printing medium discrimination sensors S1 to S5 are allowed to normally protrude from the bottom surface of the discrimination recess 4B. At this time, each microswitch is in an OFF state. In the case where the printing medium discrimination part 60 has some sensor hole(s) 60A at the positions corresponding to the printing medium discrimination sensors S1 to S5, the plunger(s) of the sensor(s) for which the printing medium discrimination part 60 has sensor hole(s) is allowed to pass through the associated sensor holes 60A without depression, leaving the corresponding microswitch(es) in the OFF state, which generates an OFF signal. On the other hand, the plunger(s) of the sensor(s) for which the printing medium discrimination part 60 has no sensor hole(s) is depressed, bringing the corresponding microswitch(es) into the ON state, which generates an ON signal.

FIGS. 7A through 7C show results of measurement of appropriate drive currents 122 to the feeding motor 119 according to various widths of the printing mediums 3A detected by the printing medium discrimination sensors S1 to S5 and results of measurement using a conventional method for comparison.

As shown in FIG. 7A, a feeding motor 119 in a conventional printer is driven at a fixed maximum drive current 122 to feed any rolled printing mediums 3A different in width. In FIG. 7B, the feeding motor 119 in the first embodiment is driven at a drive current 122 appropriate to each width of the rolled printing mediums 3A to feed each rolled printing medium 3A. As the result of the measurement, it has been found that the lower drive current 122 is applied to the feeding motor 119 for the wider rolled printing medium 3A, so that a power peak of the printer 1 (the total sum of the drive current 122 to the motor 119 and the average current to a line thermal head 31) is largely reduced. This is because a frictional force between the line thermal head 31 and a platen roller 26 is lowered as the rolled printing medium 3A is wider. This makes it possible to minimize the capacity of power supply of the printer 1, reduce the cost, and downsize the printer 1. Further, the reduction in power peak of the printer 1 can lower the generation of heat, decrease the frequency of cooldown, and enhance the printing throughput of the printer. Unevenness in printing quality of caused by an excessive drive current 122 can be reduced, and acoustic noise can be reduced. It has also been found that the drive current 122 needed to drive the feeding motor 119 varies with the materials of the rolled printing mediums 3A of the same width. Therefore, each rolled printing medium 3A may need to have information about the drive current 122 to the feeding motor 119 to feed the rolled printing medium 3A appropriately.

In the measurements shown in FIGS. 7A and 7B, the drive circuit 121 of FIG. 7C was used and the appropriate drive current 122 to the feeding motor 119 was measured by changing voltage values of the reference voltage (Vref) 124 to be applied to a constant current chopping circuit 123. In the measurement, eight types of the rolled printing mediums 3A were used as test samples including two kinds of materials; thermal paper (its base material is paper with a heat sensitive layer on its printing surface) and MKP paper (its base material is PET with a heat sensitive layer on its printing surface), each of which has four different widths of 18 mm, 36 mm, 54 mm, and 72 mm. These eight types of the rolled printing mediums 3A are detected in association with the printing medium discrimination sensors S1 to S5 respectively. The sensors S1 to S5 thus read information about the drive current 122 directly from the rolled printing medium 3A. Accordingly, a mismatch between the width and material of the rolled printing medium 3A and the drive current 122 can be avoided.

The insertion port 18 is arranged so that its one side end (a left end in FIG. 6) on the holder support member 15 side is substantially flush with the inner surface of the holding member 12 when engaged in the holder support member 15. A guide rib 23 is formed at the side end of the insertion port 18 on the holder support member 15 side. A lever 27 for operating a vertical movement of a thermal head 31 of a line type (see FIG. 8) is provided in front of the other side end (an upper end in FIG. 5) of the holder storage part 4 in the feeding direction.

Herein, as shown in FIGS. 8 and 9, when the lever 27 is turned up, a head support member 32 holding thereon the thermal head 31 is turned down, separating the thermal head 31 from a platen roller 26. When the lever 27 is turned down, the head support member 32 is turned up, causing the thermal head 31 to press the part of the rolled printing medium 3A inserted through the insertion port 18 against the platen roller 26 by pressing forces of coil springs 35 and 36 (see FIGS. 14A and 14B) placed between a bottom face of a frame 34 and the head support member 32 as mentioned later. Thus, the printer is placed in a printing enabled state. Further, a control circuit 110 is provided below the holder storage part 4. This control circuit 110 drives and controls each mechanism in response to commands from an external personal computer and others. The thermal head 31 is driven and controlled while the platen roller 26 is rotated by the feeding motor 119, so that image data can be printed in sequence on a printing surface of the rolled printing medium 3A being transported. The printed part of the rolled printing medium 3A discharged onto the tray 6 is cut with the cutter unit 8 when the cutter lever 9 is operated to move rightward in FIG. 1.

Herein, the control circuit 110 which is arranged to drive and control each mechanism in response to commands from an external personal computer will be explained with reference to FIG. 10. FIG. 10 is a control block diagram of the printer 1. The control circuit 110 formed on a control board (not shown) is a core of control structure of the printer 1. The control circuit 110 comprises CPU 111 which controls each device, and input/output interface 113, CG-ROM 114, ROMs 115, 116, and RAM 117, which are connected to the CPU 111 via data bus 112.

The CG-ROM 114 stores dot pattern data for displaying each of many characters in association with code data.

The ROM (dot pattern memory) 115 stores dot pattern data for printing each of many characters including alphabets, symbols and others in association with code data. The dot pattern data is classified by font (gothic font, Mincho font and others) and stored by the number of characters to be printed in each size for each font. The ROM 115 further stores graphic pattern data for printing graphic images including graduation.

The ROM 116 stores a printing drive control program to drive the line thermal head 31 and the feeding motor 119 at respective appropriate drive currents 122 for information about the rolled printing medium 3 detected by the printing medium discrimination sensors S1 to S5 by reading data from a printing buffer in accordance with code data of characters including letters and symbols inputted from a PC 118. The ROM 116 also stores a pulse number decision control program to determine the number of pulses corresponding to the amount of the energy for generating each print dot, and various kinds of other programs needed for controlling the printer 1. The CPU 111 carries out various operations or calculations based on the programs stored in the ROM 116.

Furthermore, the RAM 117 includes a text memory 117A, a printing buffer 117B, and a parameter storage area 117E. The text memory 117A stores text data inputted from PC 118. The printing buffer 117B stores dot pattern data on printing dot patterns of a plurality of characters and symbols and the number of pulses to be applied as the amount of energy for generating each dot. The line thermal head 31 performs dot printing according to the dot pattern data stored in the printing buffer 117B. The parameter storage area 117E stores data on various operations or calculations.

The input/output interface 113 connects to the PC 118, the printing medium discrimination sensors S1 to S5 which detects information to drive the feeding motor 119 at the appropriate drive current 122 according to the kind of the rolled printing medium 3A, a drive circuit 120 to drive the line thermal head 31, and the drive circuit 121 to drive the feeding motor 119 at the appropriate drive current 122 determined based on the information about the rolled printing medium 3A detected by the sensors S1 to S5.

Therefore, when character data is inputted through the PC 118, the text (the text data) is successively stored in the text memory 117A, and the line thermal head 31 is driven by the drive circuit 120 and performs printing of the dot pattern data stored in the print buffer 117B. The feeding motor 119 is synchronously controlled at the appropriate drive current 122 through the drive circuit 121 to feed the rolled printing medium 3A. Then, the line thermal head 31 prints the characters and others on the rolled printing medium 3A, with the heating elements which are selectively driven through the drive circuit 120 corresponding to the print dots for one line.

Figure 17:
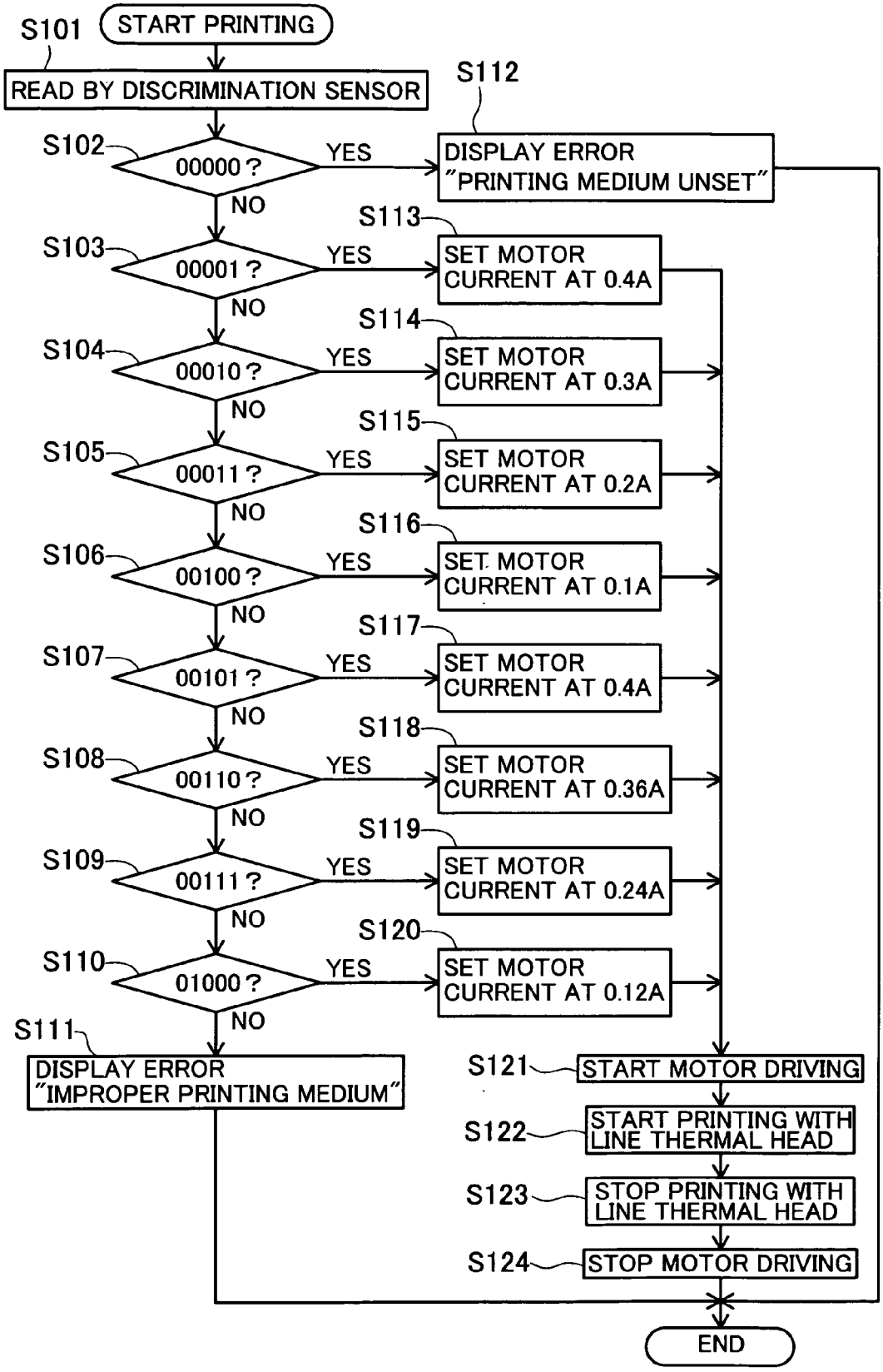
FIG. 17 is a flowchart wherein a drive current for feeding each rolled printing medium is adjusted and printing dot pattern data in the rolled printing medium.

A flowchart of the printing operation described above is shown in FIG. 17. FIG. 17 is a flowchart wherein the drive current 122 for feeding each rolled printing medium is adjusted and printing the dot pattern data in the rolled printing medium. At step (hereinafter, "S") 101 through S110, information provided in the rolled printing medium 3A is read by the printing medium discrimination sensors S1 to S5, and the kind of the rolled printing medium 3A mounted in the printer 1 is discriminated in the control circuit 110. The appropriate drive current 122 to be applied to the feeding motor 119 is set according to the kind of the rolled printing medium 3A at S113 through S120. At S121, the feeding motor 119 is driven at the appropriate drive current 122. The characters and others are synchronously printed on the rolled printing medium 3A with the heating elements heated selectively corresponding to the print dots for one line through the drive circuit 120. When the printing operation ends at S123, the feeding motor 119 stops driving. If "Yes" at S102, indicating that the printing medium is unset, an error message "Printing Medium Unset" is displayed at S112. Likewise, if "No" at S110, indicating that an improper printing medium is set, an error message "Improper Printing Medium" is displayed at S111.

Figure 11A:
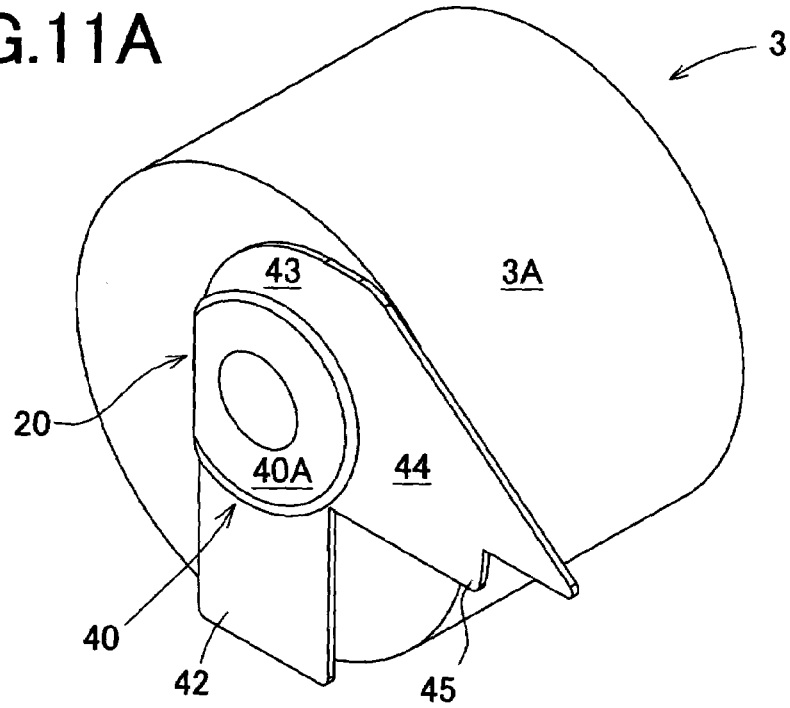
FIG. 11A is a perspective view of the rolled printing medium holder holding the rolled printing medium, seen from upper front.
Figure 11B:
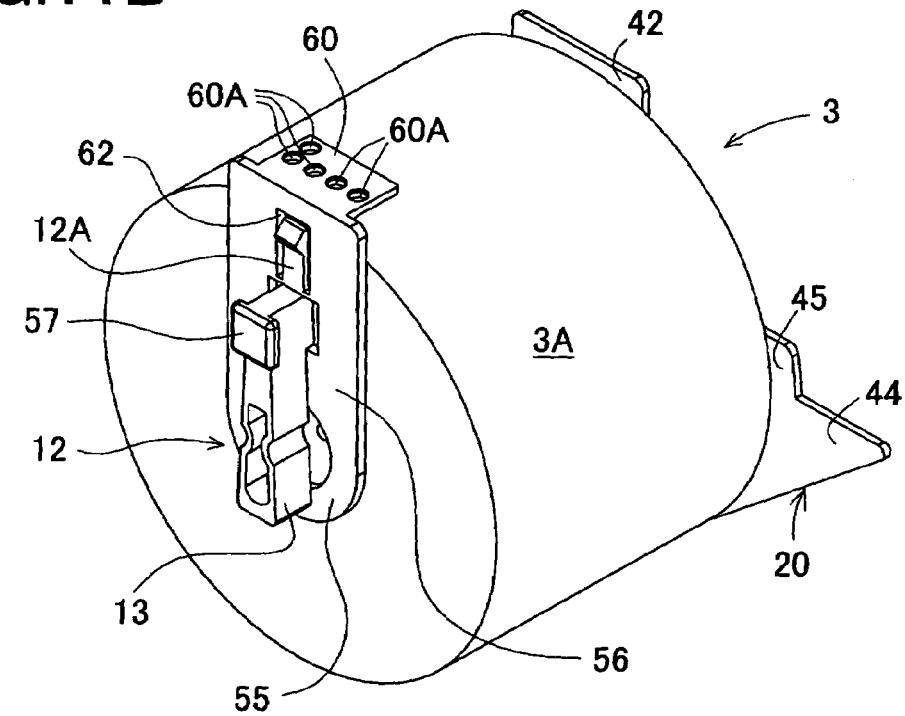
FIG. 11B is a perspective view of the rolled printing medium holder turned upside down from a state shown in FIG. 11A.

A schematic structure of the printing medium holder 3 will be described below, referring to FIGS. 4, 11A and 11B. FIG. 11A is a perspective view of the rolled printing medium holder holding the rolled printing medium, seen from upper front. FIG. 11B is a perspective view of the rolled printing medium holder turned upside down from a state shown in FIG. 11A. As shown in FIGS. 4, 11A and 11B, the printing medium holder 3 is basically constructed of the rolled printing medium 3A wound around the sheet core 3B, the guide member 20, the holding member 12, and a holder shaft 40. Specifically, the guide member 20 has a first cylindrical part 38 which is inserted in one open end of the sheet core 3B of the rolled printing medium 3A so that the guide member 20 is set in contact with one end face of the rolled printing medium 3A. The holding member 12 includes a second cylindrical part 39 which is inserted in the other open end of sheet core 3B so that the holding member 12 is set in contact with the other end face of the rolled printing medium 3A. The holder shaft 40 has one end inserted in the first cylindrical part 38, the end being formed with a radially extended flange part 40A fixed on an outer end face of the first cylindrical part 38. The holder shaft 40 also has the other end inserted and fixed in the second cylindrical part 39 of the holding member 12. Accordingly, the holder shaft 40 may be selected from among a plurality of shafts of different lengths to easily provide many kinds of rolled printing medium holders 3 holding rolled printing mediums 3A of different widths.

The guide member 20 further includes a first, second, third, and fourth extended portions 42, 43, 44, and 45. The first extended portion 42 is formed extending downward in a predetermined length from a lower periphery of the outer end face of the first cylindrical part 38. This first extended portion 42 is fitted in the positioning recess 4A formed in the bottom of the holder storage part 4 so that the lower end surface of the first extended portion 42 is brought in contact with the bottom surface of the positioning recess 4A. The second extended portion 43 is formed extending upward to cover a front quarter round of the end face of the rolled printing medium 3A. The third extended portion 44 is formed continuously extending from the second extended portion 43 up to near the insertion port 18 (see FIG. 6) and has an upper edge sloped downward to the front end. This third extended portion 44 further has a lower edge 44*a* extending horizontally, which is held in contact with the flat portion 21 of the tape printer 1 so that one side edge of the unwound part of the rolled printing medium 3A is guided along the inner surfaces of the second and third extended portions 43 and 44 up to the insertion port 18. The fourth extended portion 45 is formed under the third extended portion 44 between the rear end of the lower edge 44*a* at a predetermined distance from the front end and the first extended portion 42. When the lower edge 44*a* of the third extended portion 44 is held in contact with the placing portion 21, a front edge 45*a* of the fourth extended portion 45 is inserted in appropriate one of the second placing grooves 22A to 22D corresponding to the width of the rolled printing medium 3A set in the printing medium holder 3 (see FIG. 8).

The holder shaft 40 is provided with a slit 51 in the end portion fitted in the second cylindrical part 39 of the holding member 12. The slit 51 has a predetermined length along the longitudinal direction of the shaft 40 to engage a rib 50 formed protruding radially inward from the inner lower end of the second cylindrical part 39. Such engagement between the rib 50 of the holding member 12 and the slit 51 of the holder shaft 40 makes it possible to correctly position the holding member 12 and the guide member 20 with respect to each other through the holder shaft 40. The first and second cylindrical parts 38 and 39 serve to rotatably support the sheet core 3B of the rolled printing medium 3A. The holder shaft 40 may be selected from among a plurality of shafts of different lengths individually corresponding to the lengths of the sheet cores 3B (four shafts for each of two kinds of the printing mediums in the first embodiment).

The outer open end of the second cylindrical part 39 is closed by the holding member 12. A flange 55 is formed around the second cylindrical part 39. An extended portion 56 is continuously formed under the flange 55. Respective inner surfaces of the flange 55 and the extended portion 56 are held in contact with the end face of the rolled printing medium 3A and the sheet core 3B. On the outer surfaces of the flange 55 and the extended portion 56, the longitudinal mounting piece 13 is provided protruding outward, at substantially the center of the width of the holding member 12 in the feeding direction (a lateral direction in FIG. 11B). This mounting piece 13 is of a substantially rectangular section and has a vertical length in a direction substantially perpendicular to the central axis of the holder shaft 40 and a width which becomes smaller in a downward direction (in an upward direction in FIG. 11B) so that the mounting piece 13 is fitted in the first positioning groove 16 having a narrower width (in the feeding direction) towards the bottom of the holder support member 15 in the tape printer 1. The protruding distance of the mounting piece 13 is determined to be almost equal to the width (in a direction of the width of the tape printer 1, perpendicular to the feeding direction) of the first positioning groove 16.

The mounting piece 13 of the holding member 12 is provided, on the lower outer surface, with a guide portion 57 of a square flat plate (about 1.5 mm to 3.0 mm in thickness in the first embodiment) having a larger width than the lower portion of the mounting piece 13 by a predetermined amount (about 1.5 mm to 3.0 mm in the first embodiment) at each side of the lower portion. Accordingly, to mount the printing medium holder 3 in the tape printer 1, a user inserts the mounting piece 13 from above into the first positioning groove 16 by bringing an inner surface of the guide portion 57 into sliding contact with the outer surface of the holder support member 15. Thus, the printing medium holder 3 can easily be fitted in place.

The holding member 12 is designed to have the extended portion 56 extending downward (upward in FIG. 11B) longer by a predetermined length (about 1.0 mm to 2.5 mm in the first embodiment) than the lower end (the first extended portion 42) of the guide member 20. The holding member 12 is also provided, at the lower end of the extended portion 56, with the rolled printing medium discrimination part 60 of a substantially rectangular shape extending inward by a predetermined length at almost right angle to the extended portion 56. As mentioned above, the rolled printing medium discrimination part 60 is formed with the sensor holes 60A arranged at predetermined positions corresponding to the printing medium discrimination sensors S1 to S5 respectively. As shown in FIG. 11B, five sensor holes 60A are formed at predetermined positions corresponding to the kind of the rolled printing medium 3A held in the rolled printing medium holder 3.

Further, the holding member 12 is further formed with a longitudinally extending rectangular through hole 62 in the extended portion 56 under the mounting piece 13. An elastic locking piece 12A is provided extending downward from the upper edge (an lower edge in FIG. 11B) of the through hole 62 and formed with an outward protrusion at a lower end (an upper end in FIG. 11B).

An explanation is given to a mounting manner of the printing medium holder 3 constructed as above in the tape printer 1, referring to FIGS. 2A and 2B.

FIG. 2A shows the case where the printing medium holder 3 holds the rolled printing medium 3A of a maximum width (e.g., about 72 mm) wound on the sheet core 3B. The mounting piece 13 of the holding member 12 of the holder 3 is first inserted from above into the positioning groove 16 of the holder support member 15. The holder 3 is put so that the lower edge 44*a* of the third extended portion 44 of the guide member 20 is brought into contact with the flat portion 21. The fourth extended portion 45 is engaged in the second positioning groove 22A formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the rolled printing medium discrimination part 60 is fitted in the discrimination recess 4B formed at a position inwardly adjacent to the base end of the holder support member 15 and the elastic locking piece 12A is engaged in the recess 15A formed in the base end of the holder support member 15. Thus, the printing medium holder 3 is mounted in the holder storage part 4 to be freely removable therefrom.

While the lever 27 is in an up position, a part of the rolled printing medium 3A is drawn (unwound) and the leading end of the unwound part of the rolled printing medium 3A is inserted in the insertion port 18. During this time, one side edge of the unwound part of the rolled printing medium 3A is guided in contact with the inner surface of the guide member 20 and the other side edge is guided in contact with the protruding guide rib 23 provided on the side end of the insertion port 18. Thereafter, the lever 27 is turned down. The side edge of the inserted portion of the rolled printing medium 3A in contact with the guide rib 23 in the insertion port 18 is thus positioned in a reference point 72 (see FIGS. 14A and 14B). The leading end of the rolled printing medium 3A is then pressed against the platen roller 26 by the thermal head 31, bringing the rolled printing medium 3A into a printable state.

FIG. 2B shows the case where the printing medium holder 3 holds the rolled printing medium 3A of a width (e.g., about 36 mm) about half the maximum width, wound on the sheet core 3B. Similarly, the mounting piece 13 of the holding member 12 of the holder 3 is first inserted from above into the positioning groove 16 of the holder support member 15. The rolled printing medium holder 3 is put so that the lower edge 44*a* of the third extended portion 44 of the guide member 20 is brought into contact with the flat portion 21. The fourth extended portion 45 is engaged in the second positioning groove 22C formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the rolled printing medium discrimination part 60 is fitted in the discrimination recess inwardly adjacent to the base end of the holder support member 15 and the elastic locking piece 12A is engaged in the recess 15A formed in the base end of the holder support member 15. Thus, the printing medium holder 3 is mounted in the holder storage part 4 to be freely removable therefrom.

While the lever 27 is in an up position, a part of the rolled printing medium 3A is drawn (unwound) and the leading end of the unwound part of the rolled printing medium 3A is inserted in the insertion port 18. During this time, one side edge of the unwound part of the rolled printing medium 3A is guided in contact with the inner surface of the guide member 20 and the other side edge is guided in contact with the guide rib 23 provided on the side end of the insertion opening 18. Thereafter, the lever 27 is turned down. The side edge of the inserted portion of the rolled printing medium 3A in contact with the guide rib 23 in the insertion port 18 is thus positioned in the reference point 72 (see FIGS. 14A, 14B). The leading end of the rolled printing medium 3A is then pressed against the platen roller 26 by the thermal head 31, bringing the rolled printing medium 3A into a printable state.

In either of the above cases where the printing medium holder 3 holds the rolled printing medium 3A of the maximum width wound around the sheet core 3B as shown in FIG. 2A or the printing medium holder 3 holds the rolled printing medium 3A of the half width of the maximum width wound around the sheet core 3B as shown in FIG. 2B, the side edge of any rolled printing medium 3A on the holding member 12 side is positioned in contact with the guide rib 23 in the insertion port 18. This applies to the case where the printing medium holder 3 holds the rolled printing medium 3A of a minimum width wound around the sheet core 3B. In other words, when the printing medium holder 3 is set in the holder storage part 4, the part of the rolled printing medium 3A is inserted in the insertion port 18 so that the side edge of any rolled printing medium 3A inevitably comes into contact with the guide rib 23, regardless of the width of the rolled printing medium 3A. The inserted part of the rolled printing medium 3A in this state is fed toward the thermal head 31. It is to be noted that the maximum width of the rolled printing medium 3A is determined to be substantially equal to the length of the thermal head 31.

Figure 12:
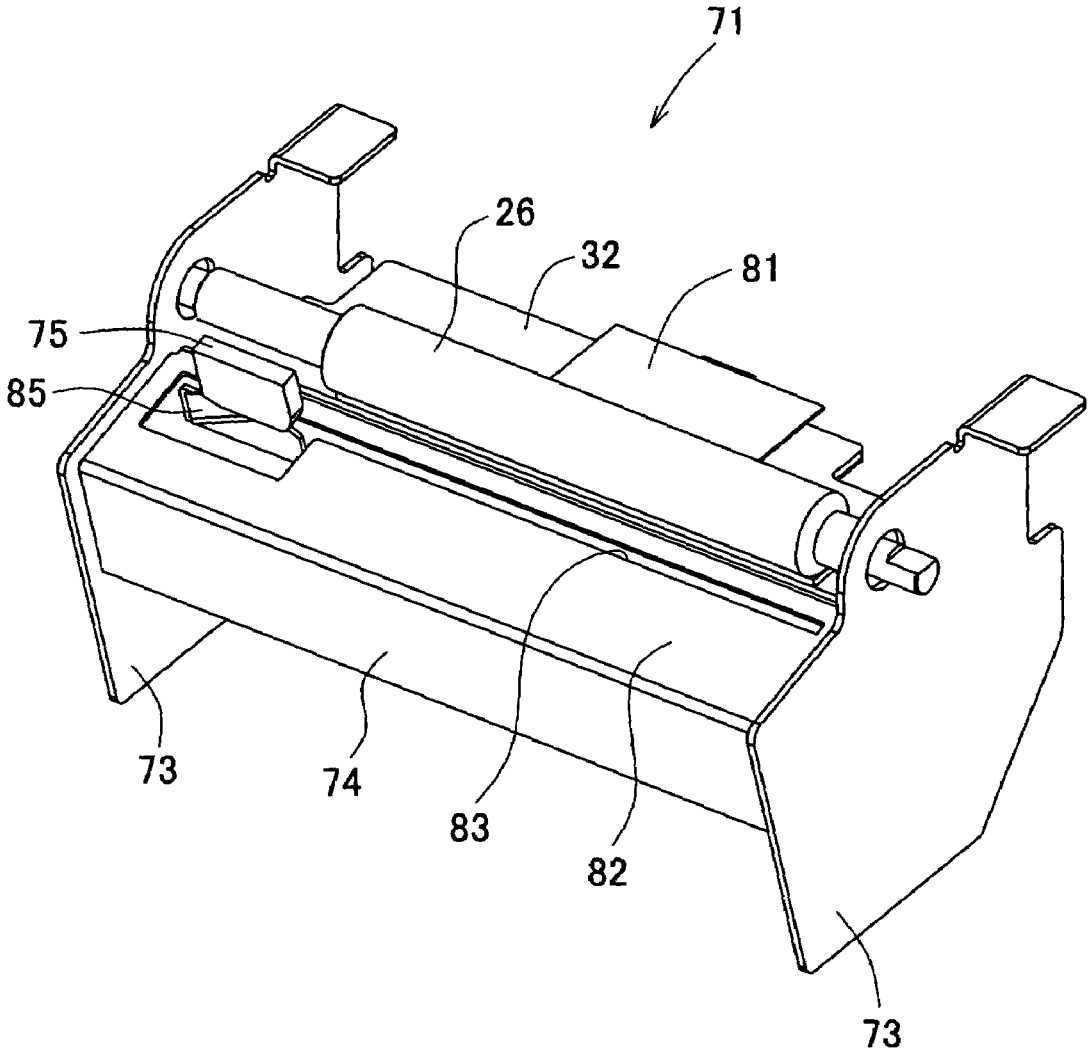
FIG. 12 is a perspective view of a printing unit and its peripheral components in the printer.
Figure 14A:
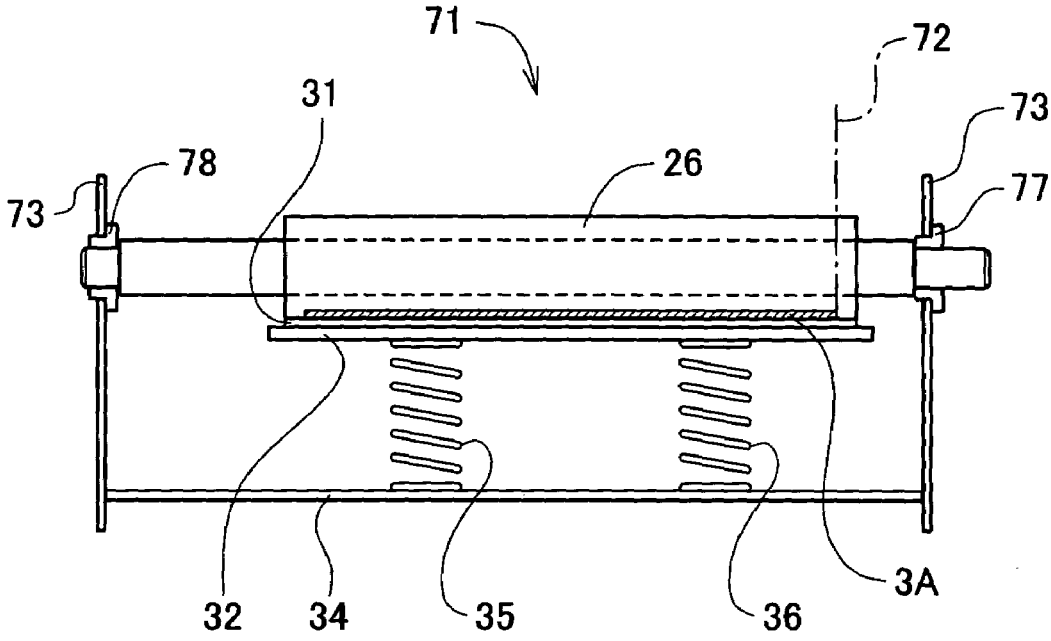
FIG. 14A is a sectional view of main parts of the printing unit in which the rolled printing medium having the maximum width is mounted.
Figure 14B:
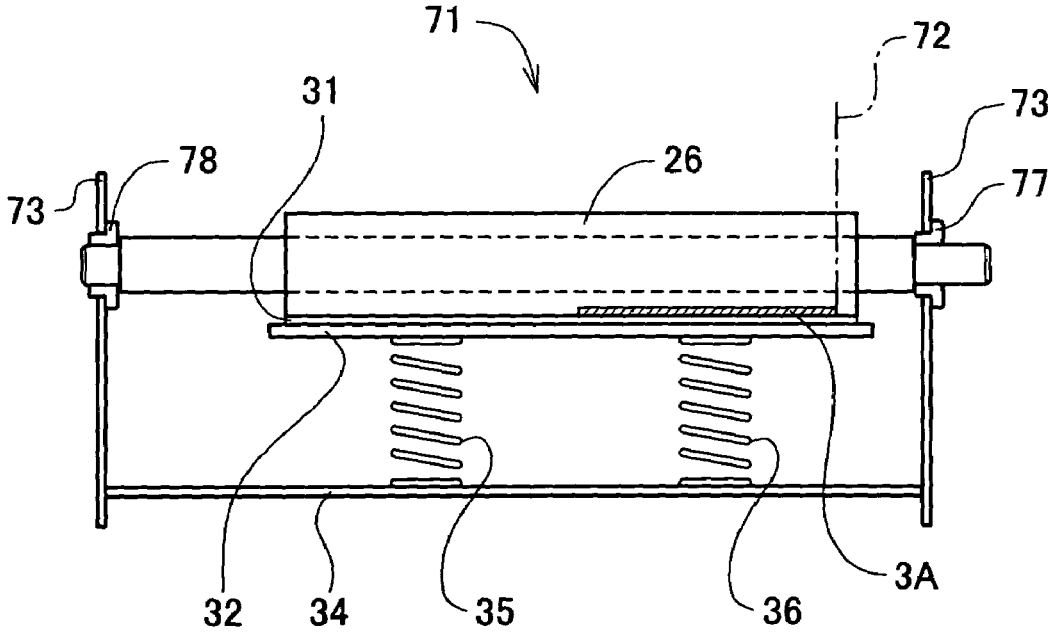
FIG. 14B is a sectional view of main parts of the printing unit in which the rolled printing medium having the width about half the maximum width is mounted.

Next, a printing unit containing the thermal head 31, the platen roller 26, and others is explained with its peripheral components, referring to FIGS. 12, 14A and 14B.

Figure 13:
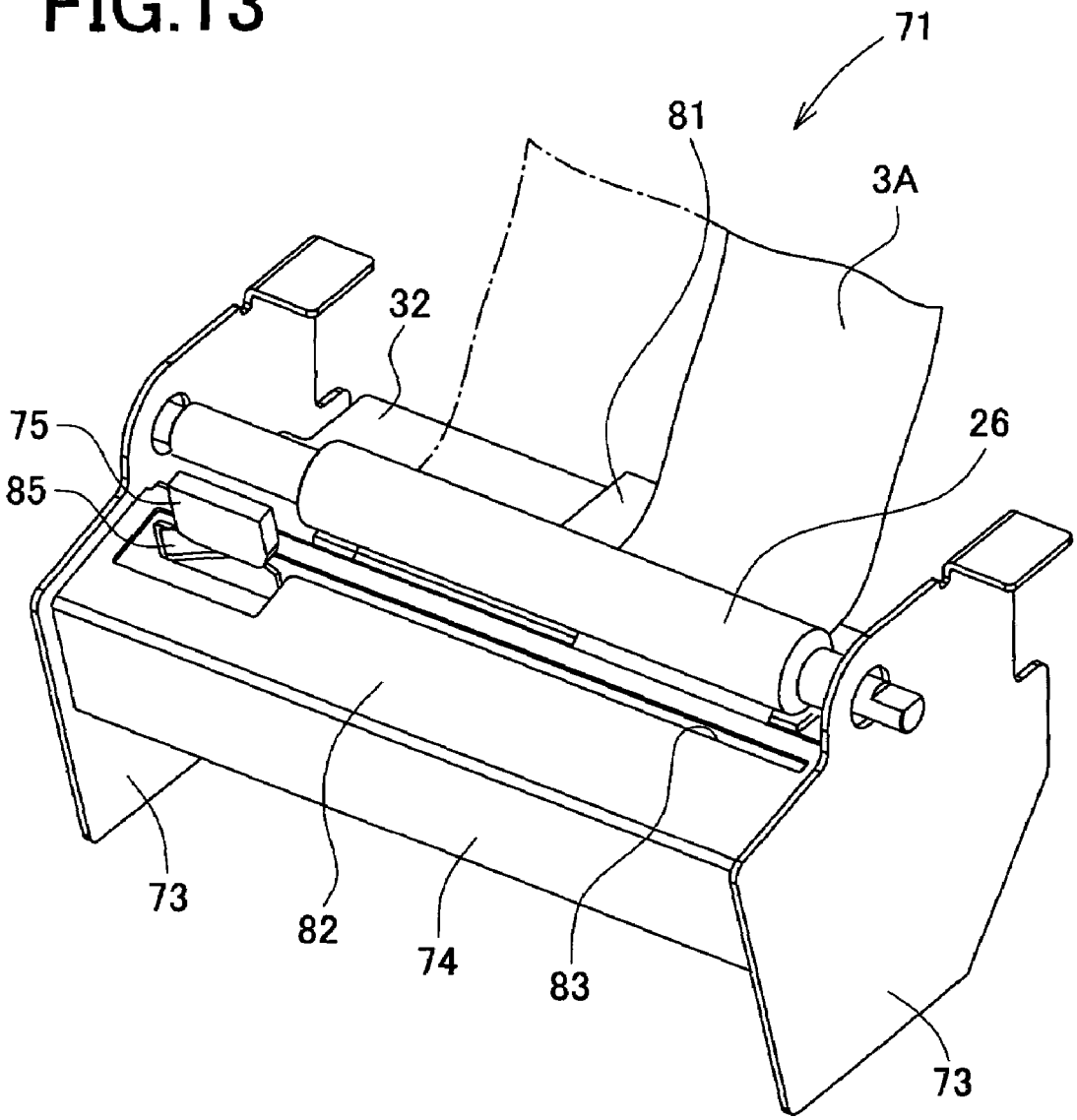
FIG. 13 is a perspective view of the printing unit and its peripheral components, in which the thermal head is separated from the platen roller and a part of the rolled printing medium is inserted in an insertion port.

FIG. 12 is a perspective view of a printing unit and its peripheral components in the printer. FIG. 13 is a perspective view of the printing unit and its peripheral components, in which the thermal head is separated from the platen roller and a part of the rolled printing medium is inserted in an insertion port. FIG. 14A is a sectional view of main parts of the printing unit in which the rolled printing medium having the maximum width is mounted. FIG. 14B is a sectional view of main parts of the printing unit in which the rolled printing medium having the width about half the maximum width is mounted.

As shown in FIGS. 12, 14A and 14B a printing unit 71 includes the frame 34 having a pair of side walls 73. Provided between the side walls 73 are the platen roller 26, the head support member 32 serving as a thermal radiation plate, a cutter plate 74, and a cutter holder 75.

This platen roller 26 is rotatably supported on the side walls 73 through respective bearings 77 and 78. The platen roller 26 is driven by the feeding motor 119 to rotate as mentioned above. The thermal head 31, an FPC substrate 81 of the thermal head 31, and others are fixedly mounted on an upper surface of the head support member 32 facing to the platen roller 26. Further, the cutter plate 74 is formed, in an upper surface, namely, a feeding surface 82 on which the rolled printing medium 3A is slidable, with a passing slot 83 formed in parallel with the platen roller 26. In the passing slot 83, the cutter holder 75 is reciprocally moved. The cutter holder 75 is provided with a movable blade 85 vertically extending through the passing slot 83 for cutting the rolled printing medium 3A.

As shown in FIGS. 9, 14A and 14B, a rear edge of the head support member 32 in the feeding direction is supported by a back portion of the frame 34 so that the head support member 32 vertically swings about the rear edge. Each coil spring 35 and 36 which presses the thermal head 31 against the peripheral surface of the platen roller 26 is disposed between the bottom face of the frame 34 and a back side of the head support member 32 facing to the thermal head 31. The springs 35 and 36 are arranged in line along the longitudinal direction of the thermal head 31 and placed so as to divide substantially equally each length from a longitudinal center of the thermal head 31 to each end in a width direction.

As shown in FIGS. 13, 14A and 14B, the rolled printing medium 3A is drawn (unwound) while the lever 27 is in the up position, and the leading end of the unwound part of the rolled printing medium 3A is inserted in the insertion port 18. During this time, one side edge of the unwound part of the rolled printing medium 3A on the holding member 12 side is guided in contact with the protruding guide rib 23 provided on the side end of the insertion port 18. Thus the side edge of the inserted portion of the rolled printing medium 3A in contact with the guide rib 23 is positioned in a reference point 72. This ensures that the side edge of the rolled printing medium 3A on the holding member 12 side is positioned in the reference point 72 regardless of the width of the rolled printing medium 3A wound on the holder 3.

When the lever 27 is then turned down, the leading end of the rolled printing medium 3A is pressed against the plate roller 26 by the thermal head 31 while the side edge of the rolled printing medium 3A on the holding member 12 side is positioned in the reference point 72.

The rolled printing medium 3A is placed in a printable state.

As shown in FIG. 14A, when the wide rolled printing medium 3A having a width substantially equal to the length of the line thermal head 31 is fed while the side edge (a right edge in FIG. 14A) of the rolled printing medium 3A is positioned in the reference point 72 near one end (a right end in FIG. 14A) of the line thermal head 31 in its longitudinal direction, the line thermal head 31 can be brought into contact under substantially uniform pressure with the entire rolled printing medium 3A. Accordingly, a direct frictional force between the line thermal head 31 and the platen roller 26 is removed, and the drive current 122 for driving the feeding motor 119 can be reduced. On the other hand, as shown in FIG. 14B, when the rolled printing medium 3A having a width substantially half the length of the line thermal head 31 is fed while the side edge of the rolled printing medium 3A is positioned in a reference point 72, the contact area of the line thermal head 31 with the platen roller 26 is larger, and the frictional force therebetween is also increased. Therefore, the larger drive current 122 needs to be supplied to drive the feeding motor 119. However, the control circuit 110 appropriately controls the drive current 122 for driving the feeding motor 119, so that the peak current which is the sum of the drive current 122 for driving the line thermal head 31 and the drive current 122 for driving the feeding motor 119 can be reduced.

As described in detail as above, the printer 1 in the first embodiment comprises the printing medium discrimination sensors S1 to S5 to read information about the drive current 122 from the rolled printing medium 3A, and the control circuit 110 to adjust the drive current 122 to be applied to the feeding motor 119 according to the information about the drive current 122 for the rolled printing medium 3A detected by the printing medium discrimination sensors S1 to S5. Accordingly, the printer drives the feeding motor 119 with the drive current 122 appropriate to the width of each rolled printing medium 3A, so that the printer can avoid a waste of the power consumption caused due to driving the feeding motor 119 by the maximum drive current 122 regardless of the width of the rolled printing medium 3A. Further, the printer can provide uniform printing quality of the rolled printing mediums 3A of any width. Furthermore, the information of the drive current 122 is directly read from the rolled printing medium 3A, so that the mismatch between the widths of the rolled printing mediums 3A and the drive current 122 can be surely avoided. The printer drives the feeding motor 119 at the drive current 122 appropriate to each rolled printing medium 3A, which makes it possible to lower the power peak, minimize the capacity of power supply, reduce the cost, and downsize the printer 1. The reduction in power peak of the printer 1 can lower the generation of heat, decrease the frequency of cooldown, and enhance the printing throughput of the printer. Further, acoustic noise caused by an excessive drive current 122 can be reduced.

In the printer 1, the rolled printing medium 3A is thermal paper, the structure of the printer 1 can therefore be simplified, achieving a reduction in cost. The rolled printing medium 3A does not have waste materials, so that it is effective for the environmental protection.

In the printer 1, the value of the appropriate drive current 122 to be applied to the feeding motor 119 is lower, as the width of the rolled printing medium 3A is wider under the condition that the rolled printing mediums 3A are made of the same material. Consequently, the power peak of the printer 1 can be reduced, which makes it possible to minimize the capacity of power supply of the printer 1, reduce the cost, and downsize the printer 1. The reduction in power peak of the printer 1 can lower the generation of heat, decrease the frequency of cooldown, and enhance the printing throughput of the printer. Moreover, acoustic noise caused by the excessive drive current 122 can be reduced.

Figure 15A:
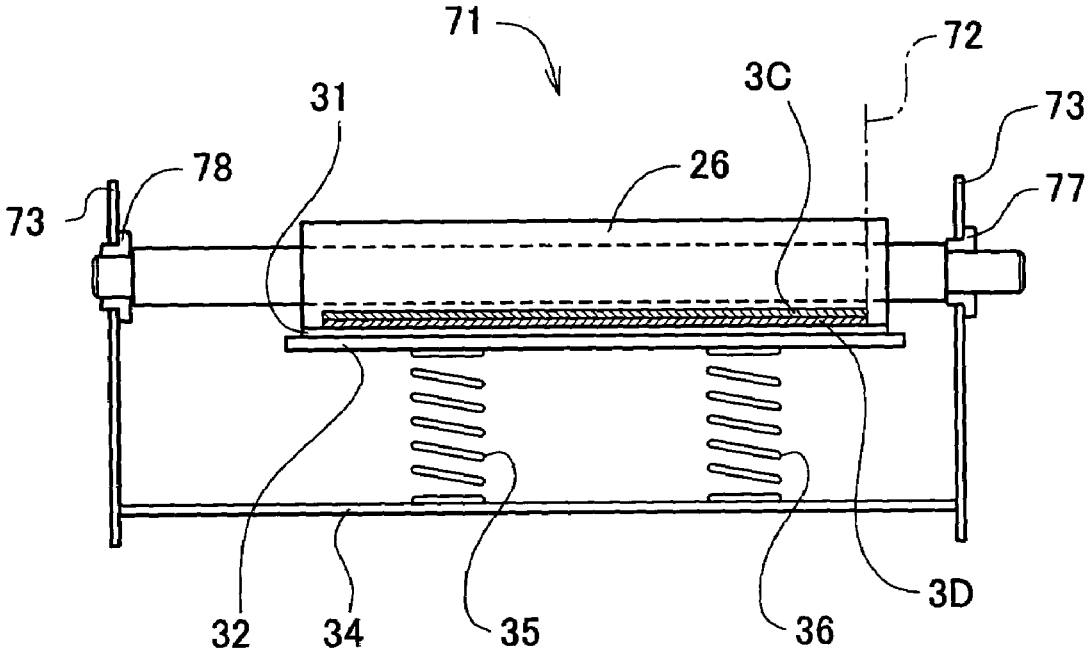
FIG. 15A is a sectional view of main parts of the printing unit to show a printing operation on the printing medium of the maximum width of the printer in a second embodiment with a thermal ink ribbon having substantially the same width as the printing medium.
Figure 15B:
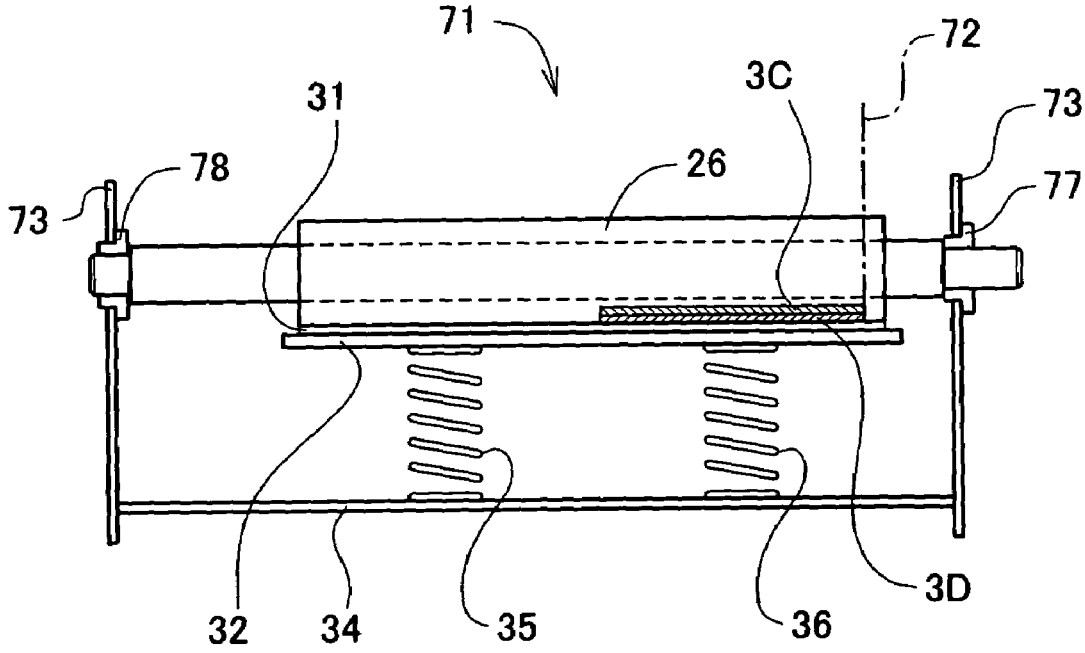
FIG. 15B is a sectional view of main parts of the printing unit to show the printing operation on the printing medium of a width half the width of the printer with a thermal ink ribbon having substantially the same width as the printing medium.
Figure 16:
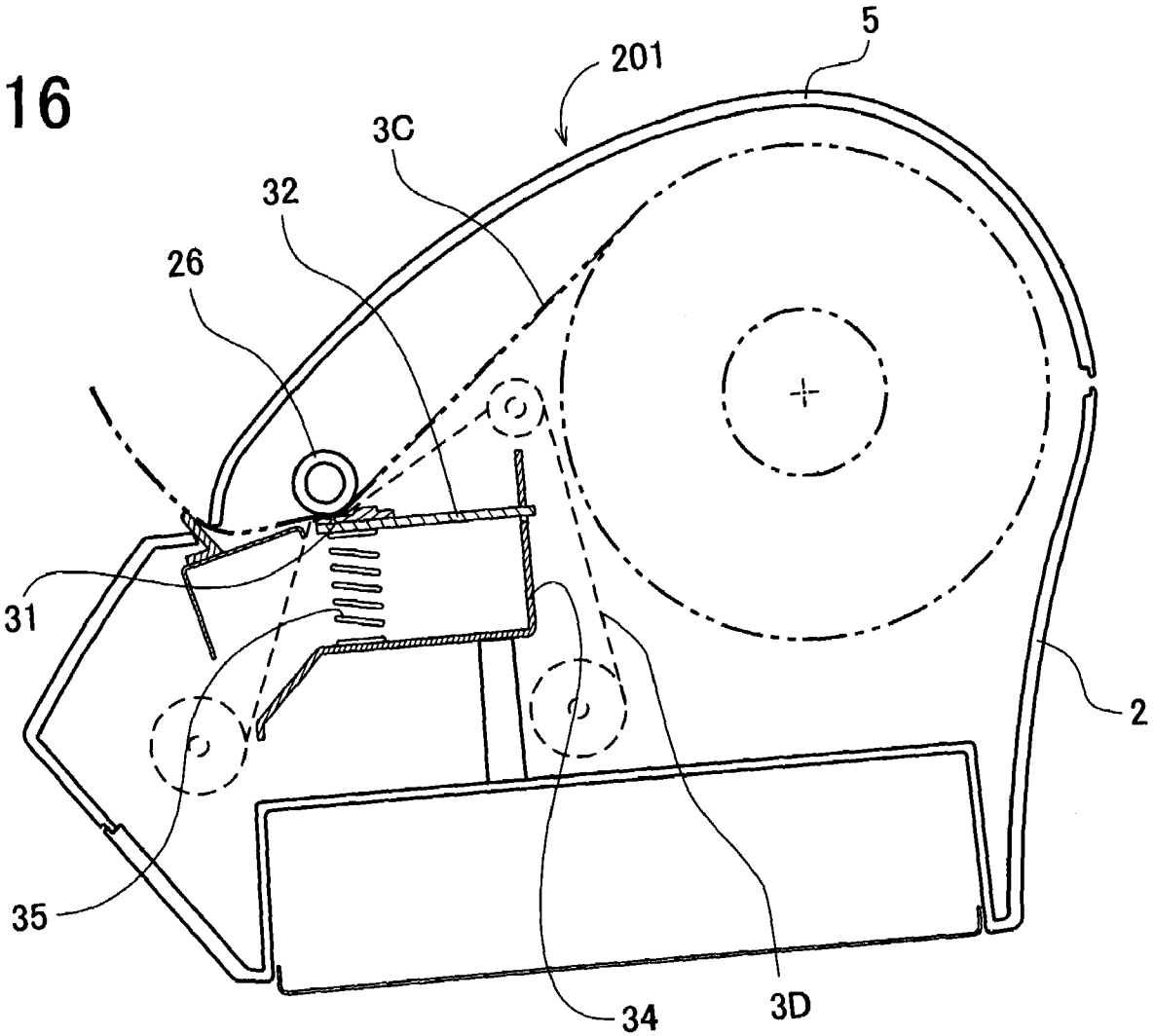
FIG. 16 is a schematic side sectional view of the printer in the second embodiment during the printing operation.

Next, a detailed description of a second preferred embodiment of a printer embodying the present invention will now be given referring to the accompanying drawings. Firstly, a schematic structure of the printer 201 in the second embodiment will be explained with reference to FIGS. 15A, 15B and 16. FIG. 15A is a sectional view of main parts of a printing unit to show a printing operation on the printing medium of the maximum width of the printer with a thermal ink ribbon having substantially the same width as the printing medium. FIG. 15B is a sectional view of main parts of the printing unit to show a printing operation on the printing medium of a width half the width of the printer with a thermal ink ribbon having substantially the same width as the printing medium. FIG. 16 is a schematic side sectional view of the printer during the printing operation. Parts which are functionally the same as those in the first embodiment are assigned the identical reference numerals to those in the first embodiment in order to omit another explanation, and only main point will be explained. The main point is that the printer 201 in the second embodiment operates printing on a rolled printing medium 3C with a thermal ink ribbon having substantially the same width as the rolled printing medium 3C. Therefore, as shown in FIG. 15A, when the wide rolled printing medium 3C and the thermal ink ribbon 3D, each having the almost same width as the line thermal head 31, are fed while the side edges of the wide rolled printing medium 3C and the thermal ink ribbon 3D are positioned in the reference point 72 set near one end (a right end in FIG. 15A) of the thermal head 31 in its longitudinal direction, the wide rolled printing medium 3C and the thermal ink ribbon 3D can be brought into contact with the line thermal head 31 under substantially uniform pressure. Therefore, the direct frictional force between the line thermal head 31 and the platen roller 26 is removed, and the drive current 122 for driving the feeding motor 119 can be reduced. On the other hand, as shown in 15B, when the rolled printing medium 3C and the thermal ink ribbon 3D each having a width substantially half the length of the line thermal head 31 are fed while the side edge of the wide rolled printing medium 3C and the thermal ink ribbon 3D are positioned in the reference point 72, the contact area of the line thermal head 31 with the platen roller 26 is larger, and the frictional force therebetween is increased. Accordingly, the drive current 122 to drive the feeding motor 119 needs to be increased. However, by controlling the drive current 122 to drive the feeding motor 119 appropriately by the control circuit 110, the peak current which is the total sum of the drive current 122 to drive the line thermal head 31 and the drive current 122 to drive the feeding motor 119 can be reduced. FIG. 16 shows a pathway of the rolled printing medium 3C and the thermal ink ribbon 3D. In that case, the rolled printing medium 3C and the thermal ink ribbon 3D need to be set individually.

As described in detail as above, the printer 201 in the second embodiment comprises the printing medium discrimination sensors S1 to S5 to read information about the drive current 122 from the rolled printing medium 3A, and the control circuit 110 to adjust the drive current 122 to be applied to the feeding motor 119 according to the information about the drive current 122 for the rolled printing medium 3A. Accordingly, the printer drives the feeding motor 119 with the drive current 122 appropriate to each width of the rolled printing mediums 3A, so that the printer can avoid a waste of the power consumption caused due to driving the feeding motor 119 by the maximum drive current 122 regardless of the width of the rolled printing medium 3A. Further, the printer can provide uniform printing quality of the rolled printing mediums 3A of any width. Furthermore, the information of the drive current 122 is directly read from the rolled printing medium 3A, so that the mismatch between the widths of the rolled printing mediums 3A and the drive current 122 can be surely avoided. The printer drives the feeding motor 119 at the drive current 122 appropriate to each rolled printing medium 3A, which makes it possible to lower the power peak. Accordingly, it is possible to minimize the capacity of power supply, which can reduce the cost, and downsize the printer 1. The reduction in power peak of the printer 1 can also lower the generation of heat, which enables the frequency of cooldown to decrease. As a result, the printing throughput of the printer can be developed. Further, acoustic noise caused by an excessive drive current 122 can be reduced. In the printer 201, the thermal ink ribbon 3D having substantially the same width as the rolled printing medium 3C is used to print on the rolled printing medium 3C. The thermal ink ribbon 3D of the maximum width can be used for the rolled printing medium of any width, so that the cost can be reduced.

In the printer 201, the value of the appropriate drive current 122 to the feeding motor 119 is lower as the width of the rolled printing medium 3C is wider under the condition that the rolled printing mediums 3C are made of the same material. Consequently, the power peak of the printer 1 can be reduced, which makes it possible to minimize the capacity of power supply of the printer 1, reduce the cost, and downsize the printer. The reduction in power peak of the printer 1 can lower the generation of heat, decrease the frequency of cooldown, and develop the printing throughput of the printer. Moreover, acoustic noise caused by the excessive drive current 122 can be reduced.

The present invention may be embodied in other specific forms without departing from the essential characteristics thereof.

For instance, the rolled printing medium 3C and the thermal ink ribbon 3D are separately set in the printer 201 in the second embodiment. Alternatively, those printing medium 3C and the thermal ink ribbon 3D may be united in a cassette.

Further, although mechanical switches are used as the printing medium discrimination sensors S1 to S5 in the embodiments, a noncontact sensor such as a photosensor, a barcode, an IC chip may be used instead.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A printer comprising:

a printing medium unit including information about a drive current;

a thermal head for printing on the printing medium;

a platen roller for feeding the printing medium;

a drive motor for driving the platen roller;

a reading device for reading the information about the drive current from the printing medium; and a controller for adjusting the drive current to be applied to the drive motor according to the information of the drive current which the reading device reads from the printing medium.

2. The printer according to claim 1, wherein the printing medium unit includes a rolled printing medium and a printing medium holder for holding the printing medium, the holder being provided with a sensor hole, and the information about the drive current being determined based on presence or absence of the sensor hole at a predetermined position.

3. The printer according to claim 2, wherein the reading device is a mechanical switch arranged corresponding to the sensor hole.

4. The printer according to claim 2, wherein the reading device is a photo sensor arranged corresponding to the sensor hole.

5. The printer according to claim 1, wherein the controller comprises a drive circuit which drives the drive motor and has a constant current chopping circuit, and the controller adjusts the drive current by controlling a reference voltage (Vref) to be applied to the constant current chopping circuit to a predetermined voltage.

6. The printer according to claim 5, wherein the drive circuit drives the drive motor at a constant current with the reference voltage (Vref) applied to the constant current chopping circuit.

7. The printer according to claim 1, wherein the printing medium is thermal paper.

8. The printer according to claim 1, comprising:

a plurality of printing mediums of different materials and widths, and the controller adjusts an appropriate value of the drive current to be applied to the drive motor so that a lower drive current is applied to the drive motor for the printing medium having a wider width for each material.

9. A printer comprising:

a printing medium unit including information about a drive current;

a thermal ink ribbon having substantially the same width as the printing medium;

a thermal head for printing on the printing medium through the thermal ink ribbon;

a platen roller for feeding the printing medium;

a drive motor for driving the platen roller;

a reading device for reading the information about the drive current from the printing medium; and a controller for adjusting the drive current to be applied to the drive motor according to the information of the drive current which the reading device reads from the printing medium.

10. The printer according to claim 9, further wherein the printing medium unit includes a rolled printing medium and a printing medium holder for holding the printing medium, the holder being provided with a sensor hole, and the information about the drive current being determined based on presence or absence of the sensor hole at a predetermined position.

11. The printer according to claim 10, wherein the reading device is a mechanical switch arranged corresponding to the sensor hole.

12. The printer according to claim 10, wherein the reading device is a photo sensor arranged corresponding to the sensor hole.

13. The printer according to claim 9, wherein the controller comprises a drive circuit which drives the drive motor and has a constant current chopping circuit, and the controller adjusts the drive current by controlling a reference voltage (Vref) to be applied to the constant current chopping circuit to a predetermined voltage.

14. The printer according to claim 13, wherein the drive circuit drives the drive motor at a constant current with the reference voltage (Vref) applied to the constant current chopping circuit.

15. The printer according to claim 9, wherein the printing medium is plain paper.

16. The printer according to claim 9, comprising:

a plurality of printing mediums of different materials and widths, and the controller adjusts an appropriate value of the drive current to be applied to the drive motor so that the appropriate value becomes lower as the printing medium is wider, when the materials of the printing mediums are the same.

* * * * *